US005639084A

United States Patent [19]

Kawasaki

[11] Patent Number: 5,639,084

[45] Date of Patent: Jun. 17, 1997

[54] BASEBALL GAME SYSTEM IN BATTING PRACTICE RANGE

[75] Inventor: Shozo Kawasaki, Kasugai, Japan

[73] Assignee: Kawasaki Corporation Kabushiki Kaisha, Aichi-ken, Japan

[21] Appl. No.: 503,906

[22] Filed: Jul. 18, 1995

[30] Foreign Application Priority Data

Jul. 19, 1994 [JP] Japan ..... 6-167047
Feb. 7, 1995 [JP] Japan ..... 7-019583

[51] Int. Cl.[6] ..... A63B 69/40

[52] U.S. Cl. ..... 473/421; 273/25; 273/DIG. 26; 463/3; 473/451; 473/570

[58] Field of Search ..... 273/25–26 A, 273/26 D, 29 A, 26 B, 72, 60 R; 364/410, 411; 463/1, 7, 30, 31, 35, 36; 473/151, 153, 157, 409

[56] References Cited

U.S. PATENT DOCUMENTS

| | | | |
|---|---|---|---|
| 3,602,506 | 8/1971 | Gentiluomo | 473/132 |
| 3,858,880 | 1/1975 | Graves | 273/29 A |
| 3,948,512 | 4/1976 | Worthington | 273/29 A |
| 3,989,246 | 11/1976 | Brown et al. | 273/29 A |
| 4,192,510 | 3/1980 | Miller | 473/157 |
| 4,199,141 | 4/1980 | Garcia | 273/26 A |
| 4,215,865 | 8/1980 | Pilati | 473/153 |
| 4,220,331 | 9/1980 | Smith | 273/26 D |
| 4,327,917 | 5/1982 | Bagley | 473/153 |
| 4,545,576 | 10/1985 | Harris | 273/25 |
| 4,770,527 | 9/1988 | Park | 273/26 A |
| 4,915,384 | 4/1990 | Baer | 273/26 A |
| 4,922,222 | 5/1990 | Baker | 473/153 |
| 4,941,662 | 7/1990 | DePerna | 273/25 |
| 4,949,972 | 8/1990 | Goodwin et al. | 273/26 A |
| 5,029,866 | 7/1991 | Beard, III et al. | 473/192 |
| 5,064,194 | 11/1991 | Bixler et al. | 273/26 A |
| 5,163,677 | 11/1992 | Foley | 473/153 |
| 5,174,565 | 12/1992 | Komori | 273/26 D |
| 5,344,137 | 9/1994 | Komori | 273/26 D |
| 5,401,016 | 3/1995 | Heglund et al. | 273/25 |
| 5,439,224 | 8/1995 | Bertoncino | 473/153 |
| 5,443,260 | 8/1995 | Stewart et al. | 273/26 R |
| 5,447,315 | 9/1995 | Perkins | 273/26 A |
| 5,479,008 | 12/1995 | Nishiyama et al. | 273/26 R |

*Primary Examiner*—Jessica Harrison
*Assistant Examiner*—Mark A. Sager
*Attorney, Agent, or Firm*—Hazel & Thomas, P.C.

[57] ABSTRACT

In a batting practice range where a pitching machine is installed to automatically pitch a ball toward a batter's box, hitting zones such as out zones, hit zones and home run zones are provided in front of the batter's box to detect a ball driven into either one of them from the batter's box for judging the ball as "Out", "Hit" or "Home run". An upright board is installed behind the batter's box and provided with a strike sensor for detecting vibration caused by a ball pitched by the pitching machine and struck the upright board and for judging the ball as "Strike". If a ball pitched by the pitching machine is not detected as any one of "Out", "Hit", "Home run" or "Strike" within a predetermined time, the ball is Judged as a foul ball.

6 Claims, 32 Drawing Sheets

| | |
|---|---|
| $K_1=1$ | 1 |
| $K_1=2$ | 0 |
| $K_1=3$ | 0 |
| TOTAL | 1 |

| | |
|---|---|
| $K_2=1$ | 1 |
| $K_2=2$ | 0 |
| $K_2=3$ | 1 |
| $K_2=4$ | 1 |
| $K_2=5$ | 0 |
| $K_2=6$ | 2 |
| TOTAL1 | 2 |
| TOTAL2 | 3 |

Fig.37

| FIRST ATTACK | | LAST ATTACK | |
|---|---|---|---|
| HITTING RATE | 0.500 | HITTING RATE | 0.333 |
| R.B.I | 4. | R.B.I | 2 |
| HOME RUN | 1 | HOME RUN | 1 |
| 1 BH | 1 | 1 BH | 0 |
| 1 BH | 1 | 1 BH | 1 |
| 1 BH | 1 | 1 BH | 2 |

| SCORE | 1 | 2 | 3 | TOTAL |
|---|---|---|---|---|
| FIRST ATTACK | 1 | 1 | 2 | 4 |
| LAST ATTACK | 1 | 1 | 0 | 2 |

BASEBALL GAME SYSTEM IN BATTING PRACTICE RANGE

CROSS REFERENCE TO RELATED APPLICATIONS

The present application is related to co-pending application Ser. No. 08/431,818, filed May 1, 1995, entitled "Baseball Game Apparatus and Ball Used in the Game," currently pending.

BACKGROUND OF THE INVENTION

1. Field of the Invention

The present invention relates to a baseball game system adapted for use in a batting practice range where a pitching machine is installed to automatically pitch a ball toward a batter's box, and more particularly to a baseball game system which enables a player to enjoy a baseball game by Judgment of a ball hit at the batter's box as "Out", "Hit", "Two-base hit", "Three-base hit" or "Home run".

2. Description of the Prior Art

In a conventional batting practice range, a pitching machine is Installed to automatically pitch a ball toward a batter's box so that a batter in the batter's box hits the ball at a predetermined time interval. There are also some batting practice ranges where a target, such as a home run, is provided on a net in front of the batter's box so that a batter in the batter's box may hit a ball toward the target.

Such conventional batting practice ranges, however, lack in enjoyment since the batter merely hits a ball pitched by the pitching machine. Even when the batter hits a ball toward a target, only he can recognize whether the ball hit the target or not.

SUMMARY OF THE INVENTION

It is, therefore, a primary object to provide a baseball game system which enables a player to enjoy a baseball game environment by using a pitching machine in a batting practice range.

According to the present invention, the primary object is accomplished by providing a baseball game system adapted for use in a batting practice range where a pitching machine is installed to automatically pitch a ball toward a batter's box, wherein a front net installed in front of the batter's box is subdivided to form an advanced runner zone, such as a single hit zone, a two-base hit zone, a three-base hit zone, a home run zone and an out zone. The baseball game apparatus further comprises hitting zone detection means for detecting a ball driven into the advanced runner zone or the out zone from the batter's box; strike counting means including an upright board installed behind the batter's box and provided with a strike sensor for detecting a ball pitched by the pitching machine striking the upright board due to a batter missing a pitched ball and means for increasing a strike-count in response to detection of the strike sensor for Judgment of an "Out" when the strike count becomes a predetermined value; out counting means for increasing an out-count when the "Out" has been judged by the strike counting means or has been detected by the hitting zone detection means that a ball was driven Into the out zone and for progressing first and last attacks in each inning and resetting the out-count when the out-count becomes a predetermined value; an electric control portion including score counting means for counting the number of advanced runners when detected by the hitting zone detection means that a ball was driven into the advanced runner zone, for calculating an advanced state of runners in each inning based on the counted number of advanced runners and for counting the number of scoring runners as a score; and display means connected to the strike counting means, the out counting means and the score counting means to display the strike-count, out-count, progress of the innings and the score.

In a practical embodiment of the present invention, it is preferable that the baseball game system further comprises a pitching sensor for detecting a ball pitched by the pitching machine and judgment means provided in the electric control portion for judging a ball hit by the batter as "Foul" if the strike sensor or the hitting zone detection means does not detect any ball within a predetermined time after detection of the ball at the pitching sensor, wherein the strike counting means increases the strike-count in response to Judgment of "Foul" at the judgment means.

BRIEF DESCRIPTION OF THE DRAWINGS

Other objects, features and advantages of the present invention will be more readily appreciated from the following detailed description of a preferred embodiment thereof when taken together with the accompanying drawings, In which:

FIG. 37 is a schematic illustration of a copy printed by a printer shown in FIG. 13.

DESCRIPTION OF THE PREFERRED EMBODIMENT

Figure 1:
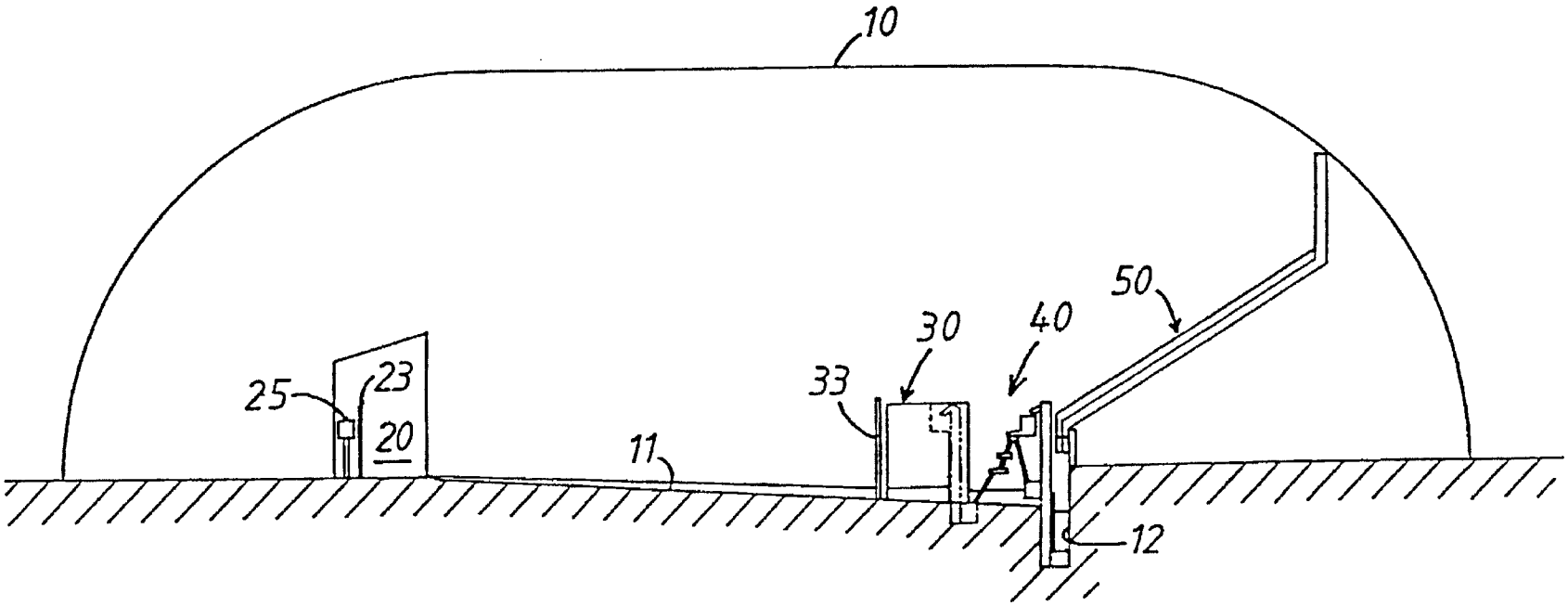
FIG. 1 is a vertical sectional view of a domed batting practice range.
Figure 2:
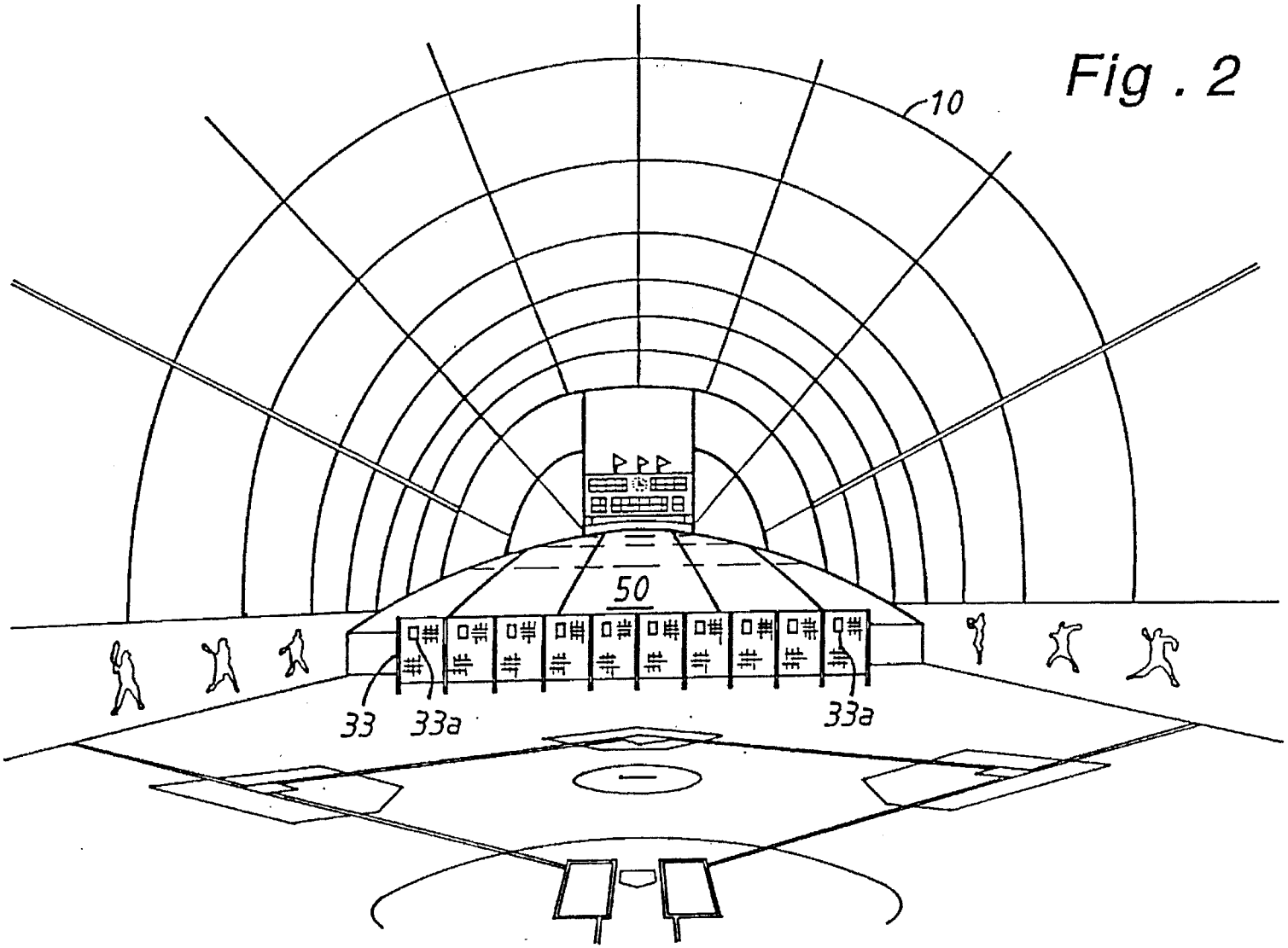
FIG. 2 is a cubic view illustrating the interior of the domed batting practice range.
Figure 3:
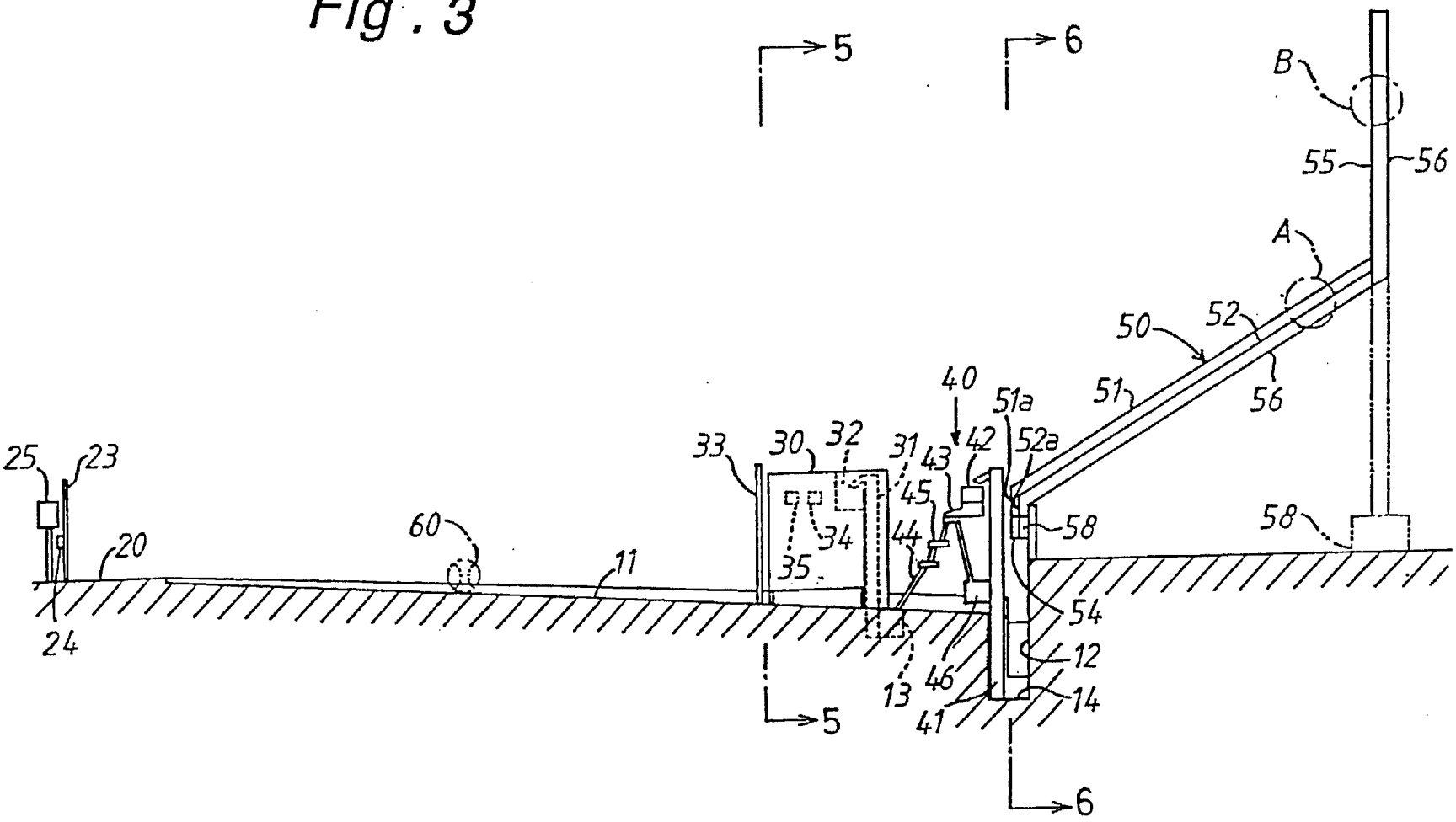
FIG. 3 is an enlarged vertical sectional view of a central portion of the domed batting practice range.
Figure 4:
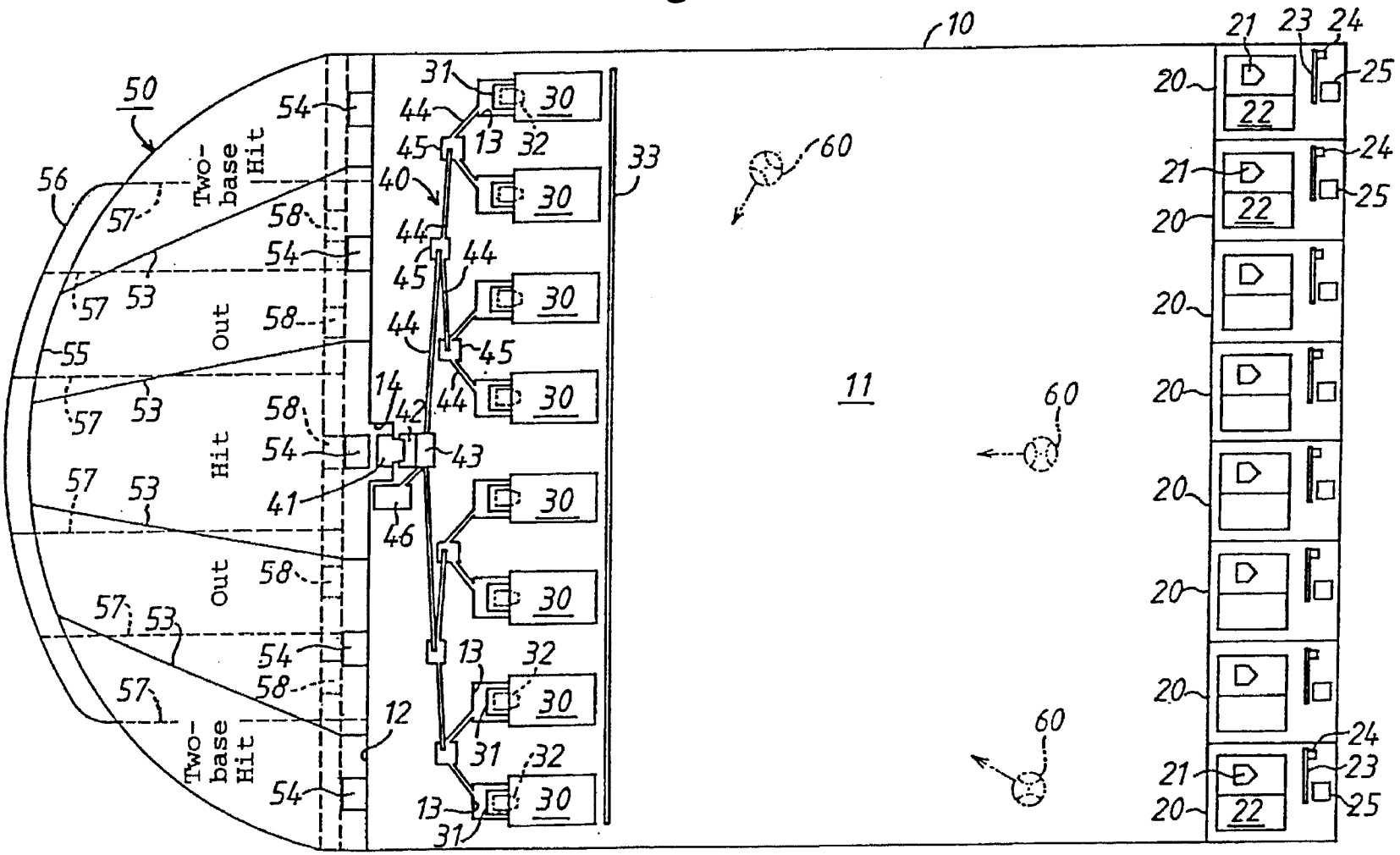
FIG. 4 is an enlarged plan view of the batting practice range.
Figure 5:
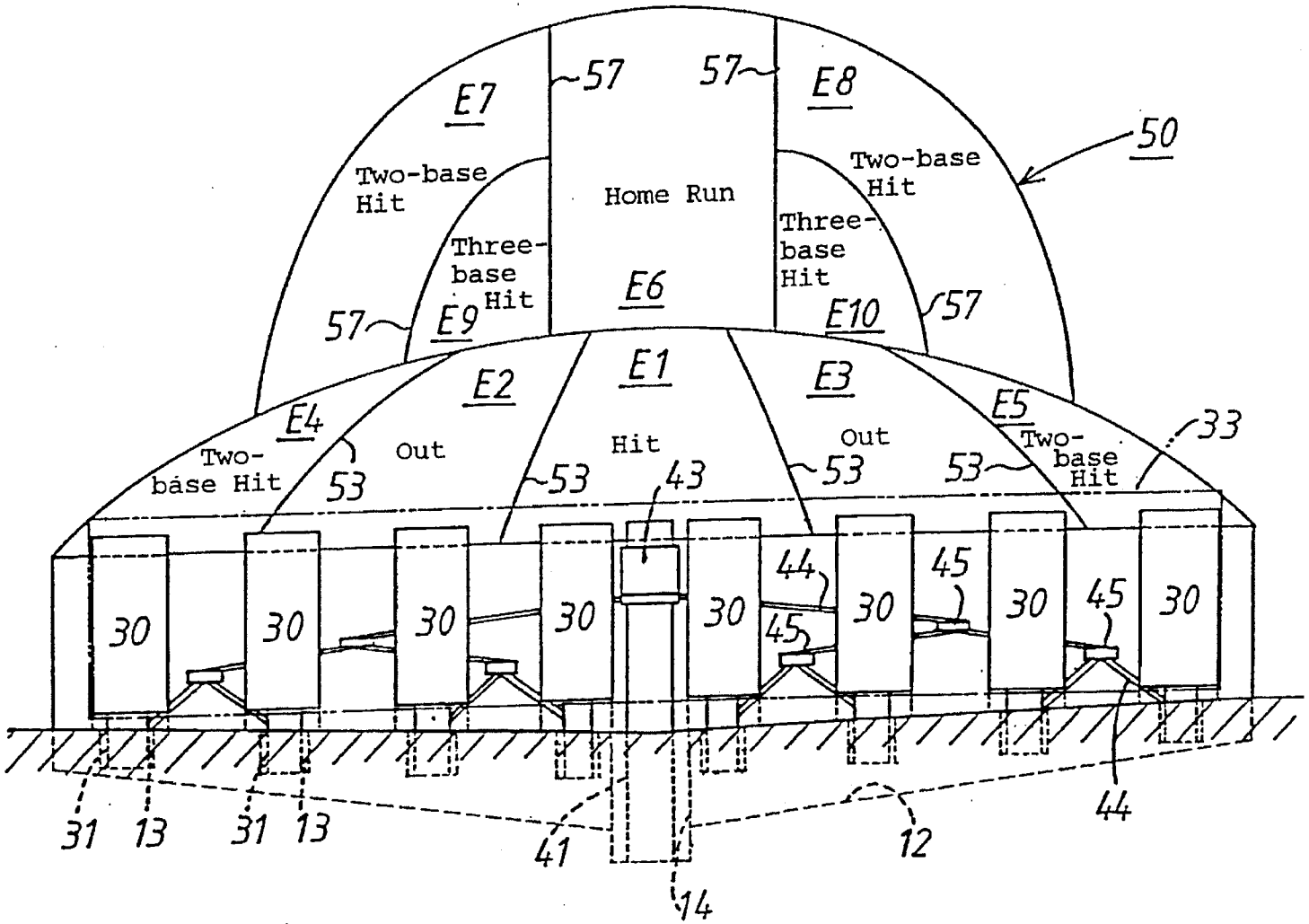
FIG. 5 is a sectional view taken along line 5—5 in FIG. 3.
Figure 6:
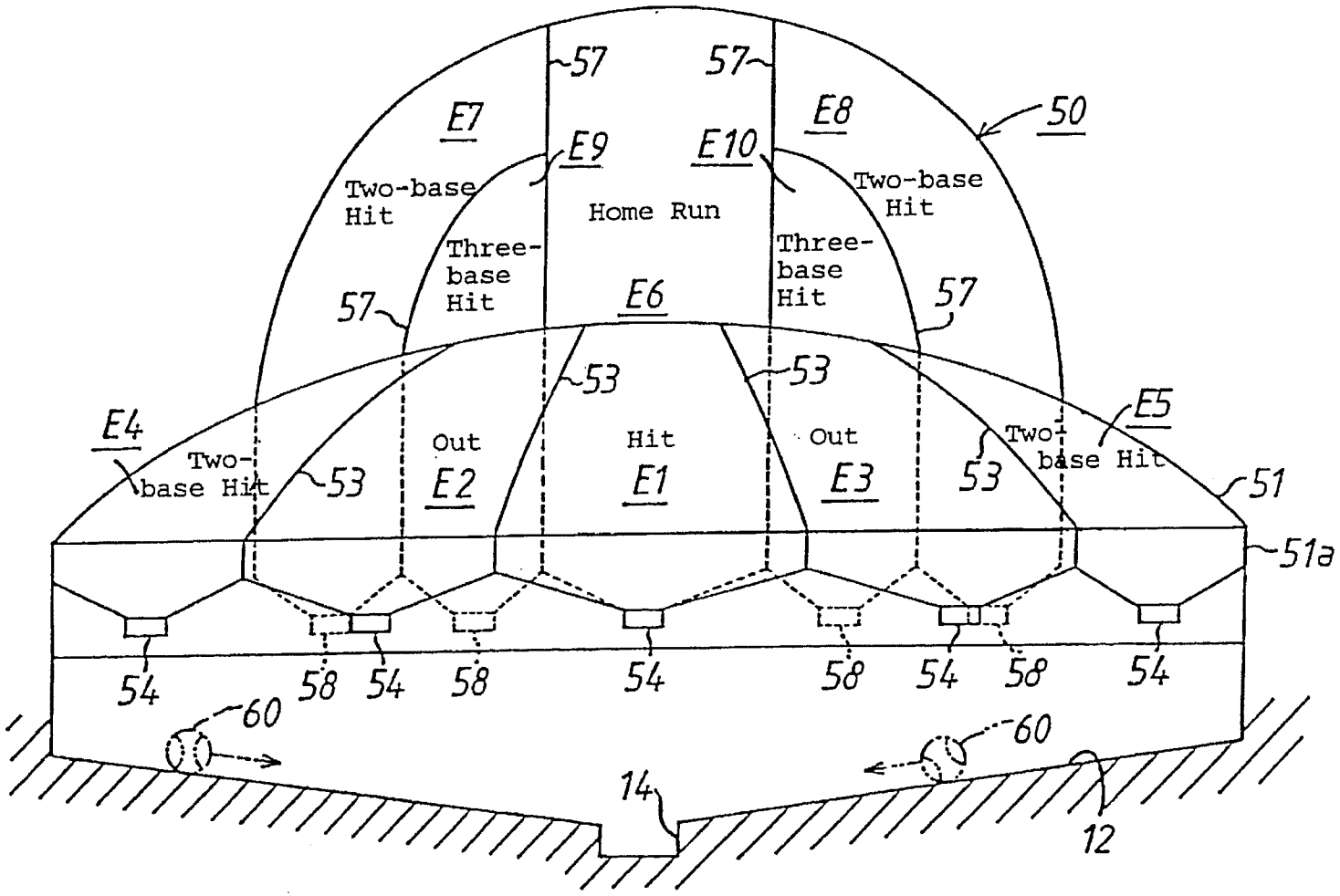
FIG. 6 is a sectional view taken along line 6—6 in FIG. 3.

Hereinafter, a preferred embodiment of the present invention will be described with reference to the drawings. FIG. 1 depicts, in a vertical section, a domed batting practice range 10, FIG. 2 depicts the interior of the domed batting practice range 10 in looking forward, FIG. 3 depicts, in an enlarged vertical section, a central portion of the domed batting practice range 10, FIG. 4 is an enlarged plan view of the central portion of the batting practice range 10, FIG. 5 is a sectional view taken along line 5—5 in FIG. 3, and FIG. 6 is a sectional view taken along line 6—6 in FIG. 3.

The domed batting practice range 10 has a semi-cylindrical central roof portion the opposite ends of which are respectively formed in a hemispherical shape. In the domed batting practice range 10, a plurality of laterally spaced batter's boxes 20 (eight batter's boxes in this embodiment) are provided at the rear, and a plurality of laterally spaced pitching machines 30 and ball supplying devices 40 associated therewith are installed in front of the batter's boxes 20. Provided also in the domed batting practice range 10 is a front net 50 which is opposed to the batter's boxes 20. The floor 11 of the domed batting practice range 10 is lowered forwardly from the batter's boxes 20, and a lateral gutter 12 is provided at the front end of net 50. In addition, the floor 11 and lateral gutter 12 are lowered toward their centers from opposite sides thereof so that a ball 60 falling on the floor 11 at the front of the net 50 is collected at the center of lateral gutter 12.

The batter's boxes 20 each are provided with a home plate 21 and a batter's area 22. Provided behind the home plate 21 is an upright board 23 which is opposed to the pitching machine 30 to receive a pitched ball 60. The upright board 23 is equipped with a strike sensor 24 in the form of a detector for detecting the ball 60 struck the upright board 23 by vibration. Arranged behind the upright board 23 is a batter's box control unit 25 to be operated by a batter. In the batter's box 20, a foul switch 26 for designation of a foul ball is embedded at a position adjacent the home plate 21 to be operated by the batter.

The pitching machines 20 each are provided with a vertical conveyer 31 for automatically conveying upward balls supplied from the ball supplying device 40 and accumulated in a recessed portion 13 on the floor 11 and with a stocker 32 for temporarily storing therein the balls 60 conveyed by the vertical conveyer 31. The pitching machines 30 each are further provided with a ball transfer mechanism (not shown) for supplying the balls 60 from the stocker 32 one by one to a cup provided on the distal end of a pitching arm member (not shown) and a driving mechanism for automatically rotating the arm member. In the pitching machines 30, the ball 60 received by the cup is pitched by rotation of the arm member toward the batter's box 20. Provided in front of the pitching machine 30 is a protective net 33 for protection of the pitching machine 30. The protective net 33 is formed with an opening which allows the pitched ball 60 passing therethrough. Between the lower end of protective net 33 and the floor 11, there is a space larger in diameter than the ball 60 to allow the ball 60 passing therethrough. The pitching machine 30 is further provided with a ball transfer sensor 34 mounted on the ball transfer mechanism for detecting a ball 60 supplied to the cup of the arm member and with an arm sensor 35 for detecting rotation of the arm member. Thus, a ball detector is composed of the sensors 34 and 35 to detect the ball 60 pitched by the arm member.

Figure 16:
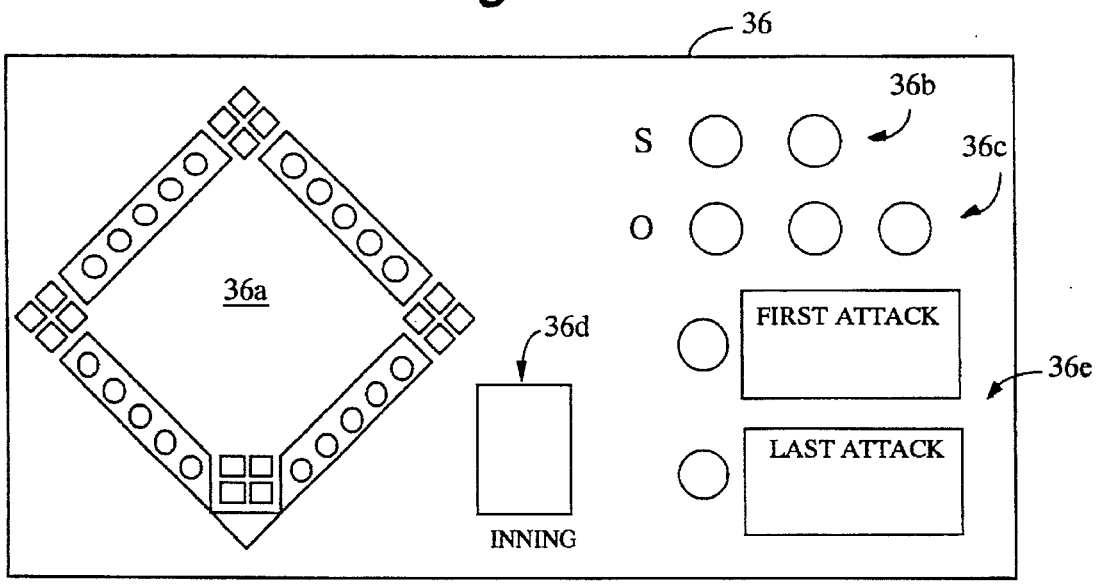
FIG. 16 illustrates in detail a score board shown in FIGS. 2 and 13.

The protective nets 33 each are provided with a score board 36 which faces each of the batter's boxes 20 to be visually recognized. As shown in FIG. 16, the score board 36 is provided with an advanced runner indicator 36*a*, a strike-count indicator 36*b*, an out-count indicator 36*c*, an inning indicator 36*d* and a score indicator 36*e*. The advanced runner indicator 36*a* is composed of lamps arranged in a square to correspond with first, second, third and home bases and a plurality of lamps aligned between the respective bases. The strike-count indicator 36*b* is composed of two lamps arranged adjacent the character S indicative of "Strike", and the out-count indicator 36*c* is composed of three lamps arranged adjacent the character "0" indicative of "Out". The inning indicator 36*d* is composed of a numeral indicator for indication of an inning of a baseball game. The score indicator 36*e* is composed of lamps arranged adjacent numeral indicators for indication of the side at bat.

The ball supplying device 40 is provided with a vertical conveyer 41 for automatically conveying upward balls 60 accumulated in a recessed portion 14 at the center of lateral gutter 12 and a stocker 42 for temporarily store therein the balls 60 conveyed upward by the vertical conveyer 41. The balls 60 stored in the stocker 42 are successively supplied to a sorter 43 one by one at each time when selection of the balls 60 is completed. The sorter 43 is constructed to sort out the balls 60 in kind to be pitched toward the respective batter's boxes 20, to transfer the ball 60 into either one of left and right chutes 44 connected thereto and to control the transfer direction of the balls 60 by means of a distributor 45 located at each turning point of the chutes 44 for supplying the balls 60 respectively into the recessed portions 13 located below each vertical conveyer 31 of the pitching machines 30. In addition, unsorted balls are discharged from the sorter 43 into a stocker 46.

Figure 9:
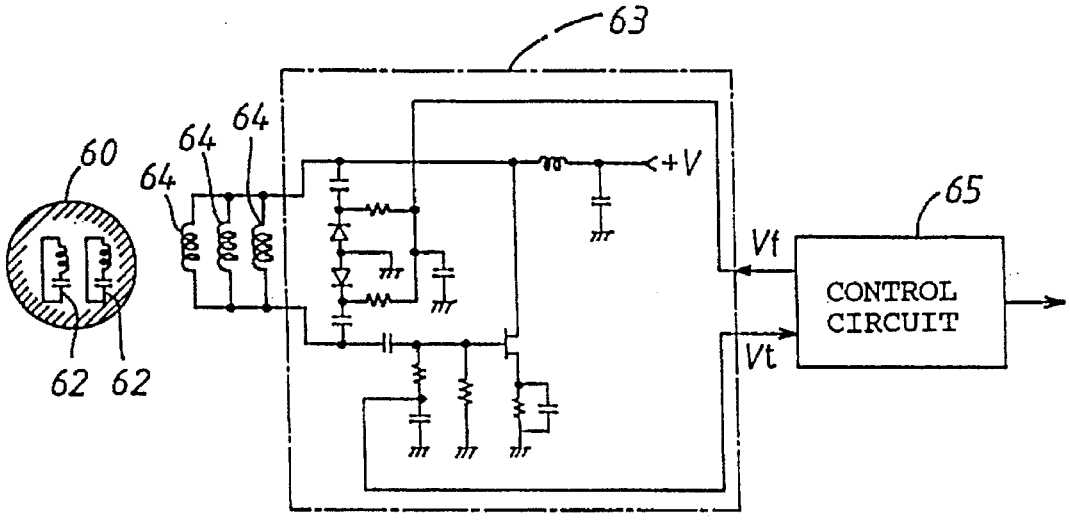
FIG. 9 is a diagram of an electric circuit of a detector for detecting a ball in kind.
Figure 10:
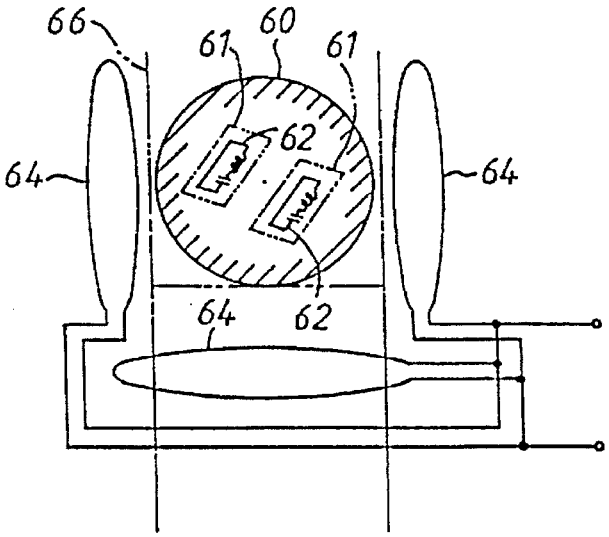
FIG. 10 depicts a ball in relation to an arrangement of coils shown in FIG. 9.

Hereinafter, detection means of the balls 60 will be described. As shown in FIGS. 9 and 10, the balls 60 each are provided therein with a pair of resonance circuits 62 each composed of a coil L and a condenser C mounted on a flexible plate 61. Each resonance frequency of the resonance circuits 62 is determined in a different value so that each kind of balls 60 can be identified by a combination of different frequencies. For example, the different frequencies are determined as $f_0$–$f_4$ to sort ten kinds of different balls.

Figure 11:
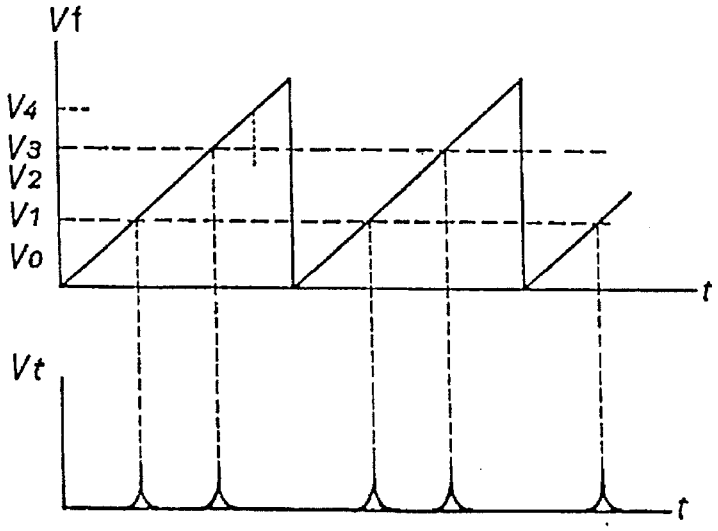
FIG. 11 is a graph showing a voltage-frequency characteristic of an oscillator shown in FIG. 9.
Figure 12:
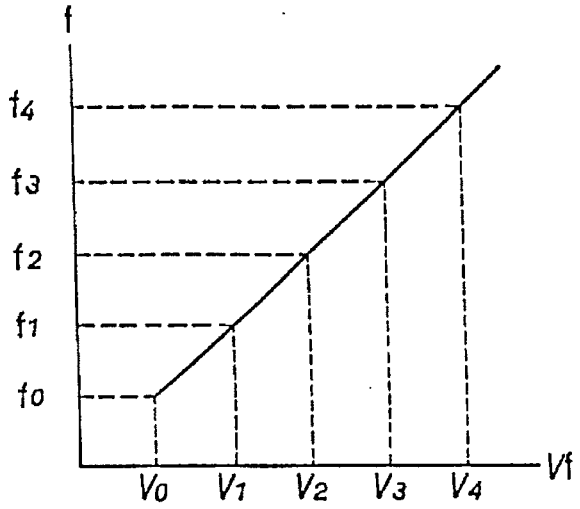
FIG. 12 is a time chart showing a sweep voltage signal and resonance peaks caused by a control circuit shown in FIG. 9.

The detector contained in the sorter 43 includes an oscillator 63 of the Colpitts type with a signal receiving function and three coils 64 with an antenna function for resonance with the resonance circuits 62. The oscillation frequency of oscillator 63 is controlled by a control voltage Vf applied from a control circuit 65 and is preliminarily determined in relation to the control voltage Vf as shown in FIG. 11. The coils 64 are arranged on three planes perpendicularly crossing one another in a casing 66 positioned on a passage of the balls 60 to cause resonance of an oscillation signal from tile oscillator 63 with the resonance circuits 62. As shown in FIG. 12, the control circuit 65 produces a saw-toothed waveform signal as the control voltage Vf and is applied with resonant voltages as shown in the figure to sort the balls 60 in kind on a basis of a combination of time positions of resonant peaks.

Figure 7:
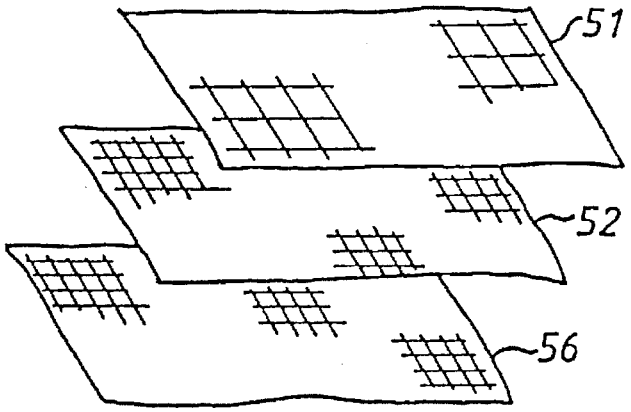
FIG. 7 is a perspective view of nets of a portion indicated by the reference character A in FIG. 3.

The front net 50 includes two-layered first and second nets 51 and 52 which are spread upward in a semi-circular shape in a forward direction from an upper portion of the gutter 12. As shown in FIG. 7, the first net 51 is composed of a coarse-meshed net which permits the balls passing therethrough, except for a vertical lower portion 51*a* thereof. The vertical lower portion 51*a* of first net 51 and the second net 52 each are composed of a fine-meshed net which blocks passage of the balls. Provided between the front nets 51 and 52 are a plurality of partitions 53 which are respectively composed of a fine-meshed net and spread radially to subdivide the surfaces of first and second front nets 51, 52 into a "Hit" zone E1, "Out" zones E2, E3 and "Two-base Hit" zones E4, E5. The characters "Hit", "Out" and "Two-base Hit" are indicated on a printed cloth attached to the second net 52 located at the hitting zones E1–E5. The lower vertical portions 51, 51*a* of first and second front nets 51 and 52 located in the hitting zones are inclined toward each center thereof so that balls 60 rolling down on the second net 52 at the respective hitting zones E1–E5 are collected at each center of the hitting zones E1–E5 between the vertical portions 51, 52*a* of first and second front nets 51 and 52. At each lower end of the vertical portions 51, 52*a* of the nets in the hitting zones E1–E5, there is provided an identifying device 54 which contains the detector shown in FIG. 9 to produce an identification signal indicative of each kind of ball 60.

Figure 8:
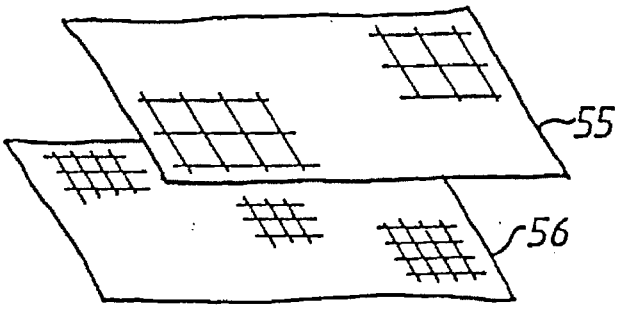
FIG. 8 is a perspective view of nets of a portion indicated by the reference character B in FIG. 3.

The front net 50 further includes two-layered third and fourth nets 55 and 56 which are vertically extended upward from each upper end of the first and second nets 51 and 52 and spread in a semi-circular shape. The fourth net 56 is extended close to the ball supplying device 40 along the bottom surface of the second net 52. As shown in FIG. 8, the third net 55 is composed of a coarse-meshed net which allows the balls 60 to pass therethrough. The fourth net 56 is composed of a fine-meshed net which blocks passage of the balls 60. Provided between the nets 55 and 56 are a plurality of partitions 57 which are respectively composed of a fine-meshed net and spread to subdivide the surfaces of third and fourth nets 55 and 56 into a "Home Run" zone E6, "Two-base Hit" and zones E7, E8 and "Three-base Hit" zones E9, E10. The characters of "Home Run", "Two-base Hit", "Three-base Hit" are indicated on each printed cloth attached to the front net 56 at the hitting zones E6–E10. The lower portions of third and fourth nets 55, 56 located in the hitting zones E6–E10 are inclined toward each center thereof so that balls 60 rolling down on the fourth net 56 at the respective hitting zones E6–E10 are collected at each center of the hitting zones E6–E10 between the third and fourth nets 55 and 56. At each lower end of the third and fourth nets 55 and 56, there is provided an identifying device 58 to produce an identification signal indicative of each kind of ball 60. Although the identifying device 58 has been arranged adjacent the ball supplying device 40, the identifying device 58 may be arranged below the third and fourth nets 55 and 56 as shown by imaginary lines in FIG. 3 to hasten arrival of the balls thereto.

Figure 13:
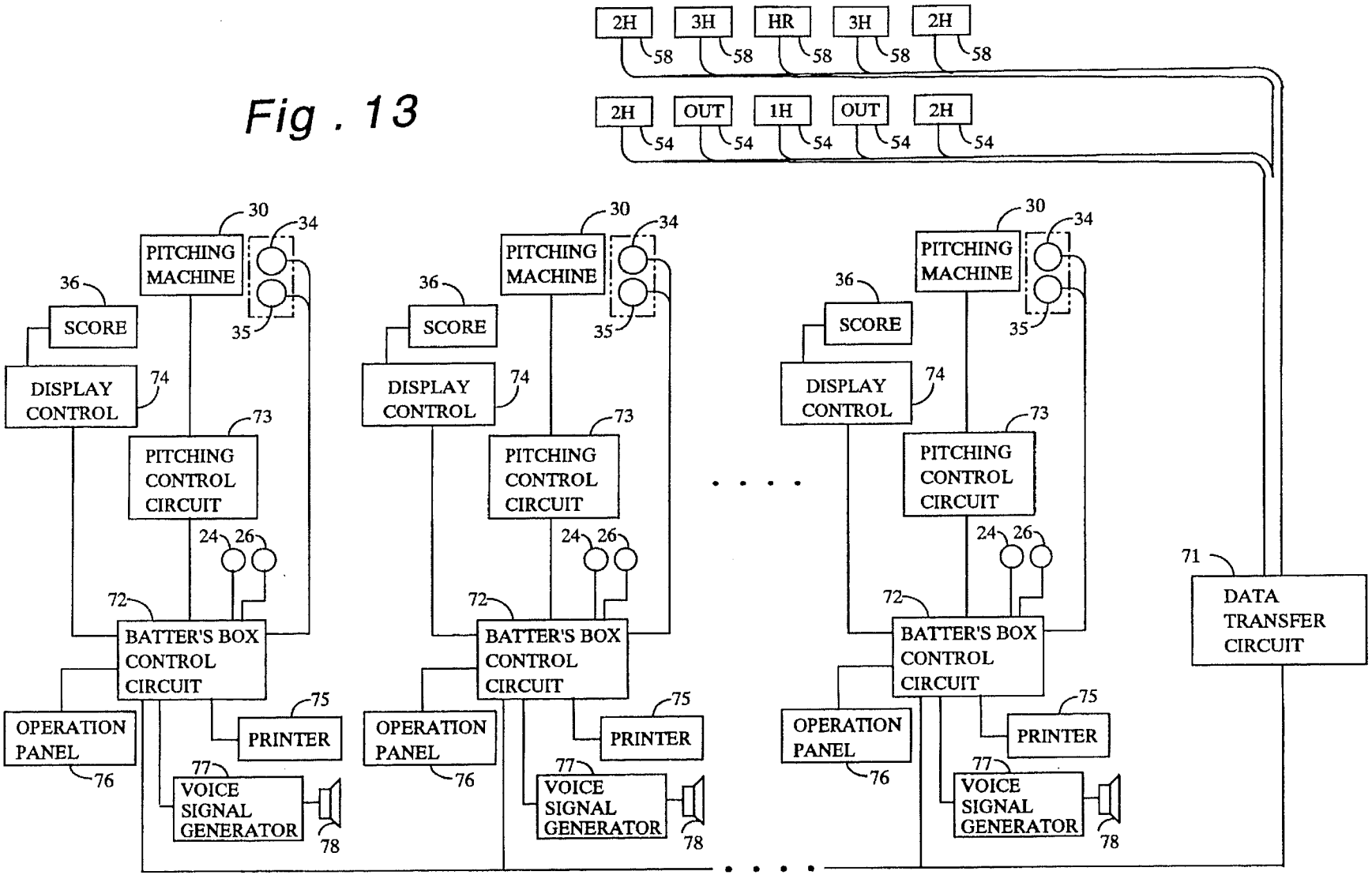
FIG. 13 is a block diagram of an electric control portion of the baseball game system.
Figure 18:
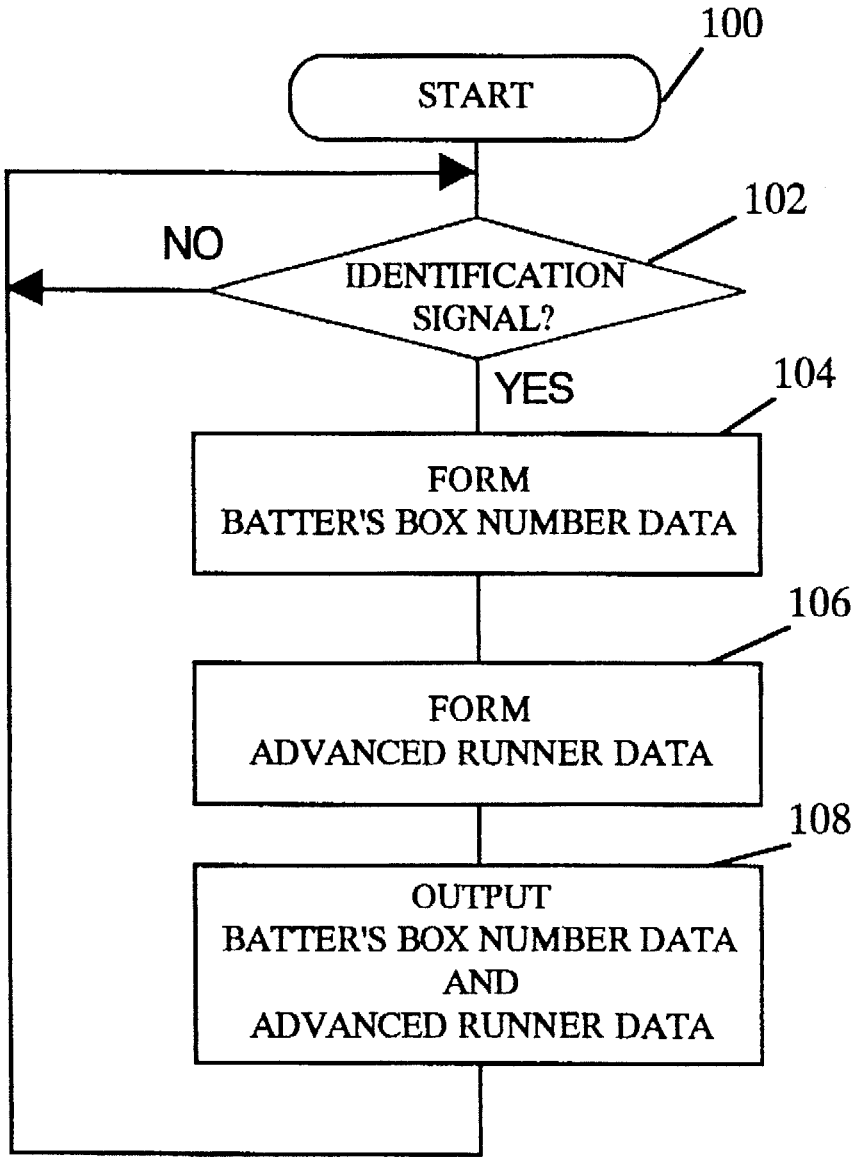
FIG. 18 is a flow chart of a program executed by a data transfer circuit shown in FIG. 13.

Hereinafter, an electric control portion of the baseball game system will be described with reference to a block diagram shown in FIG. 13. The electric control portion includes a data transfer circuit 71 connected to the identifying devices 54 and 58, respectively. The data transfer circuit 71 includes a microcomputer as a main component which executes a program shown by a flow chart in FIG. 18 for determining a batter's box where a ball was driven by a batter into the respective hitting zones E1–E10. The data transfer circuit 71 is connected to a plurality of batter's box control circuits 72 respectively housed within the control units 25 of the batter's boxes 20.

The batter's box control circuits 72 each are connected to the strike sensor 24, foul switch 26, ball transfer sensor 34 and pitching arm sensor 35. The batter's box control circuits 72 each include a microcomputer as a main component which executes programs shown by flow charts in FIGS. 19–36 for judgment of "Hit", "Out", "Foul" or "Strike" at the respective batter's boxes 20 and for calculation of a score of the game.

Figure 17:
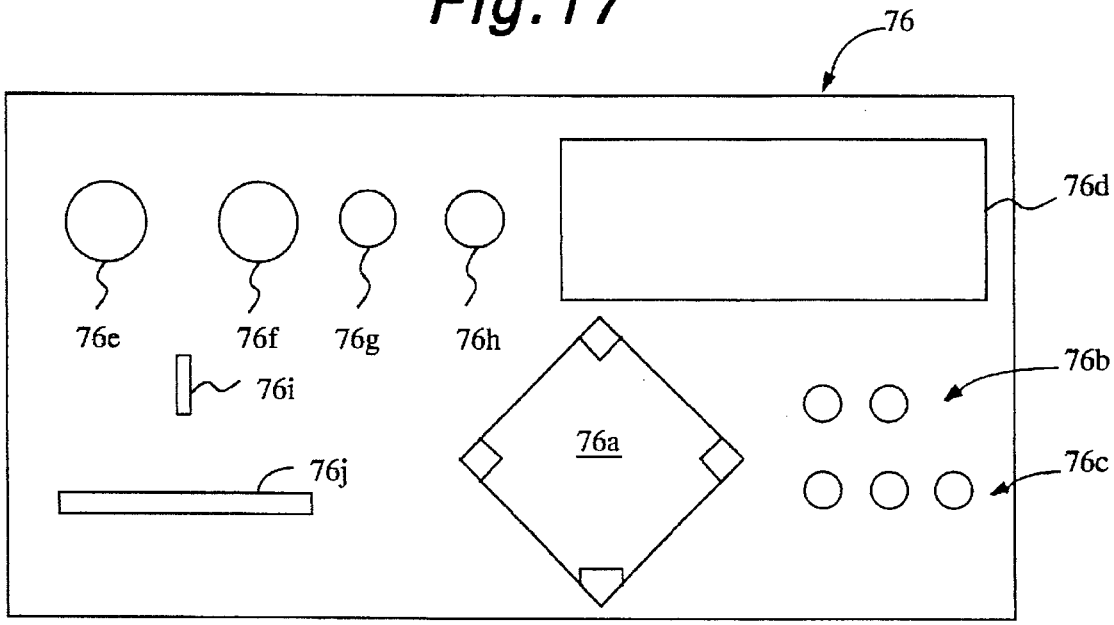
FIG. 17 illustrates in detail an operation panel shown in FIG. 13.

The batting control circuits 72 each are connected to a pitching control circuit 73 for control of the pitching machine 30, a display control circuit 74 for control of the indicators 36*a*–36*e* on the score board 36 a printer 75 provided on the batting control box 24 to print a result of batting, an operation panel 76 and a voice signal generator 77. As shown in FIG. 17, the operation panel 76 is provided thereon with an advanced runner indicator 76*a*, a strike-count indicator 76*b*, an out-count indicator 76*c*, a liquid crystal indicator 76*d*, a practice mode switch 76*e*, a game mode switch 76*f*, a one-person mode switch 76*g*, a two-person mode switch 76*h*, a coin insert slot 76*i* and a pre-paid card insert slit 76*j*. The advanced runner indicator 76*a* is composed of four indication lamps arranged in each position corresponding with first, second and third bases and a home plate. The strike-count indicator 76*b* is composed of two indication lamps arranged adjacent the character "S" indicative of "Strike", and the out-count indicator 76*c* is composed of three indication lamps arranged adjacent the character "0" indicative of "Out". The liquid crystal indicator 76*d* is provided to indicate the number of innings and a score, etc.

The practice mode switch 76e is provided to designate a mode for hitting a ball pitched by the pitching machine 30, and the game mode switch 76f is provided to designate a game mode for playing a baseball game. The one-person and two-person mode switches 76g and 76h are provided to respectively designate the number of players for playing the baseball game. The coin insert slot 76i and pre-paid card insert slit 76j are provided to insert a coin or a pre-paid card for activation of the pitching machine 30.

The voice signal generator 77 is designed to record voice signals of voices such as "A pitcher threw a ball", "Strike", "Out", "Foul", "Hit", "Two-base hit", "Three-base hit", "Home run" thereby to reproduce the voice signals in response to a designation signal from the batter's box control circuit 72. The reproduced voice signals are sounded from a loud speaker 78 connected to the voice signal generator 77 to inform the batter of "throwing of the ball" and various results of judgment.

Operation of the above embodiment will be described hereinafter. Assuming that a number of balls 60 in eight kinds have been prepared for the batter's boxes 20 and put on the floor 11 or into the gutter 12, the balls 60 are sorted in kind by the sorter 43 in the ball supplying device 40 and supplied to the pitching machines 30 respectively. In the case that a number of balls 60 for the respective batter's boxes 20 are preliminarily sorted in kind, the balls 60 may be distributed to the pitching machines 30 respectively.

Figure 19:
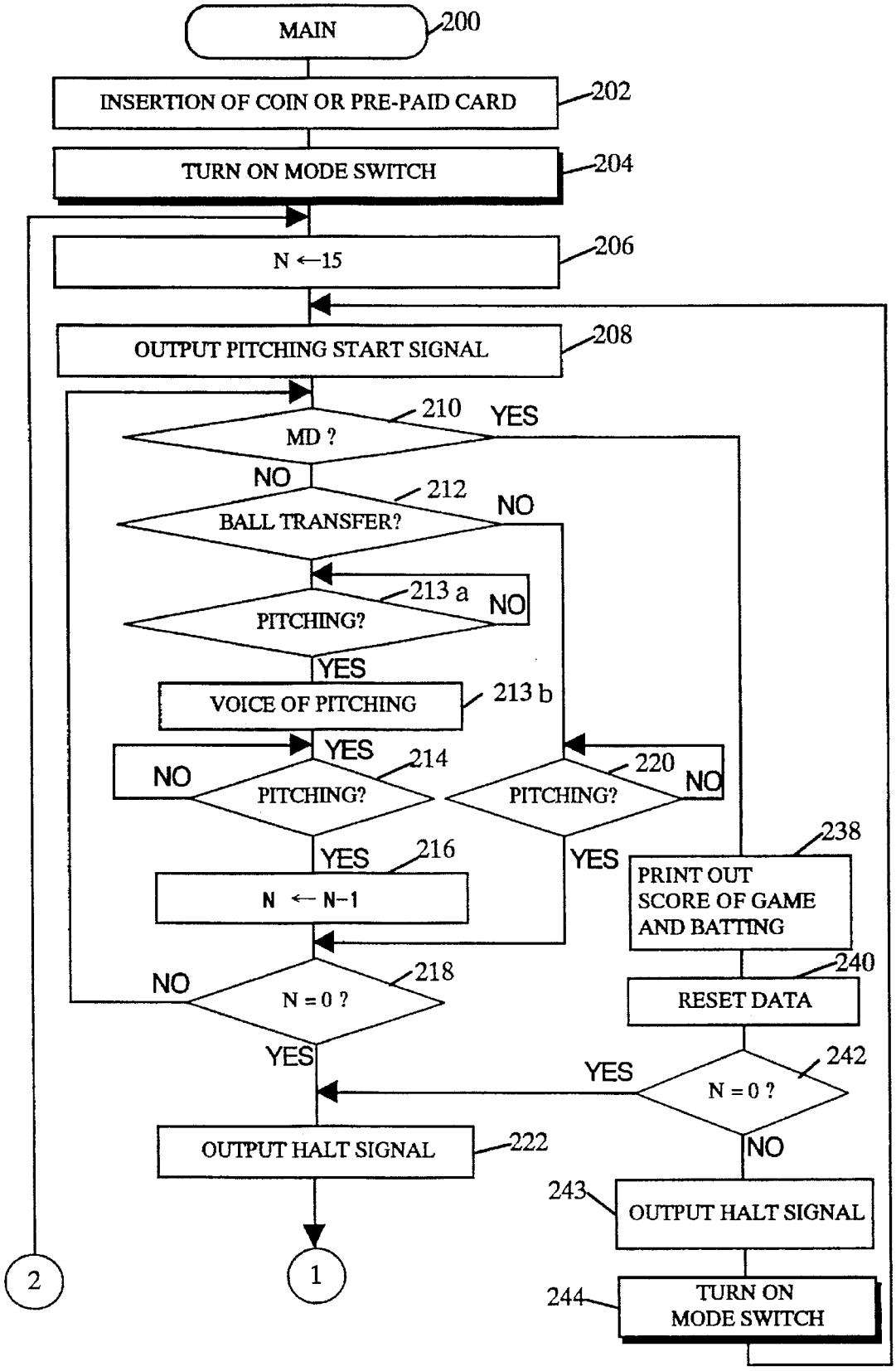
FIG. 19 is a flow chart showing a front half of a main program executed by the batter's box control circuit shown in FIG. 13.
Figure 20:
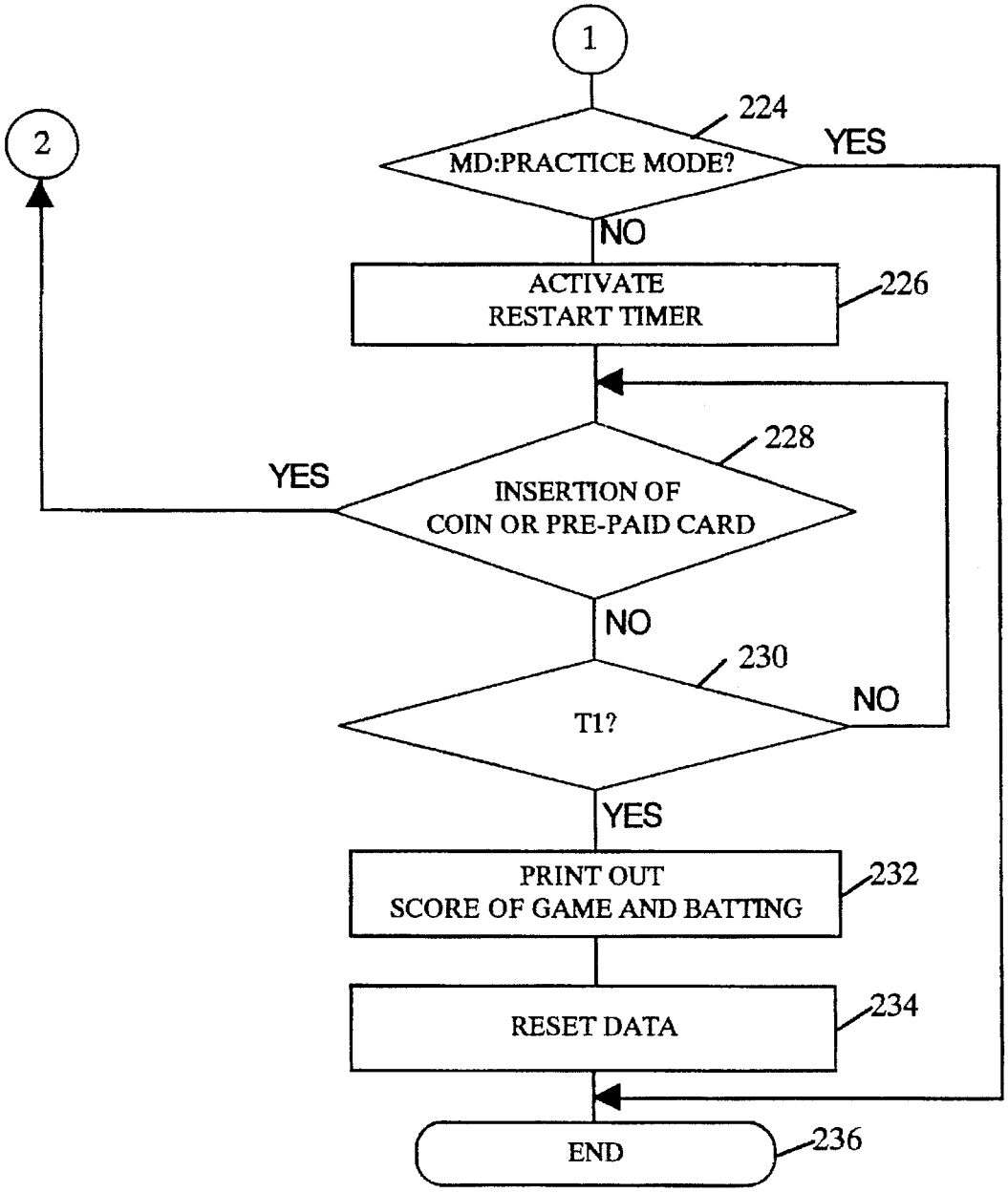
FIG. 20 is a flow chart showing a rear half of the main program.
Figure 21:
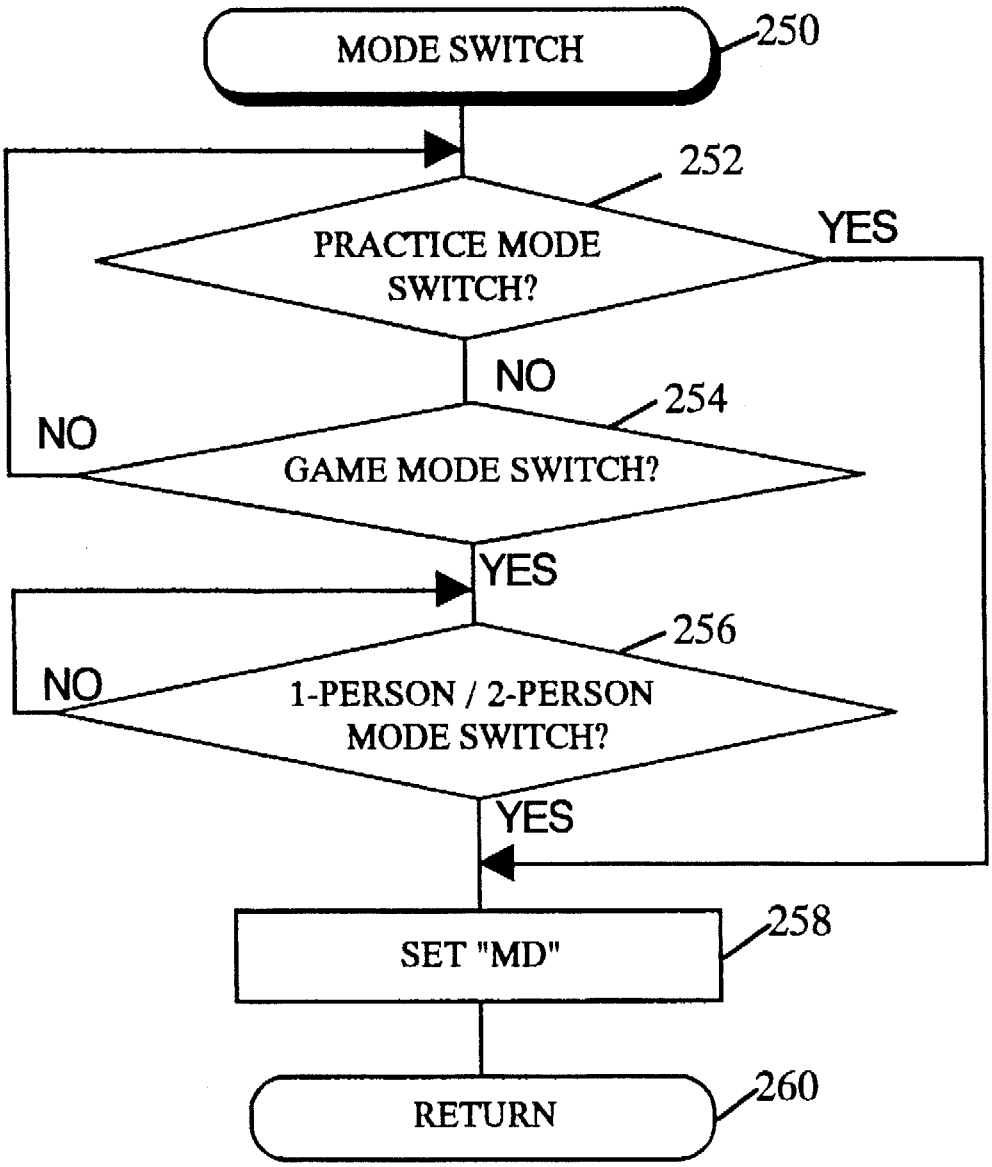
FIG. 21 is a flow chart of a mode-switch routine shown in FIG. 19.

When an electric power source switch (not shown) is turned on in a management room, the batter's box control circuits 72 start to execute the main program at step 200 shown in FIGS. 19 and 20 and wait for insertion of a coin or a pre-paid card. When a batter enters into the batter's box 20 and drops a coin the coin insert slot 76i of the operation panel 73 or inserts a pre-paid card into the pre-paid card slit 76j, the batter's box control circuit 72 causes the program to proceed to step 204 after confirmed insertion of the coin or the balance of the pre-paid card. In case the pre-paid card is used, a predetermined fee is subtracted from the balance of the card. At step 204, the batter's box control circuit 72 executes a mode switch routine shown in FIG. 21.

During execution of the mode switch routine, the switches 76e–76h on the operation panel 76 (see FIG. 17) are operated by the batter to set a mode data MD. When the practice mode switch 76e is turned on, the batter's box control circuit 72 determines a "Yes" answer at step 252. sets at step 258 the mode data as a value indicative of a practice mode and finishes execution of the mode switch routine at step 260. When the game mode switch 76f is turned on, the batter's box control routine 72 determines a "Yes" answer at step 254 to determine operation of the one-person mode switch 76g or the two-person mode switch 76h. When the one-person mode switch 76g is turned on, the batter's box control circuit 72 determines a "Yes" answer at step 256, sets the mode data as a one-person game mode and finishes execution of the mode switch routine at step 260. When the two-person mode switch 76h is turned on, the batter's box control circuit 72 determines a "Yes" answer at step 256, sets the mode data as a two-person game mode and finishes execution of the mode switch routine at step 260.

After execution of the mode switch routine at step 204 shown in FIG. 19, the batter's box control circuit 72 initializes at step 206 a value N indicative of the remaining number of balls to be continuously pitched as a predetermine value (for instance, "15") and applies a pitching start signal to the pitching control circuit 73 at step 208. When applied with the pitching start signal, the pitching control circuit 73 activates the pitching machine 30 to automatically pitch a ball at a predetermined time interval (for instance, 10 sec. interval). The time interval can be adjusted to a desired value.

After processing at step 208, the batter's box control circuit 72 determines at step 210 whether the mode data is present or not. As the mode data MD is being set as the practice mode or the game mode, the batter's box control circuit 72 determines a "No" answer at step 210 and causes the program to proceed to steps 212–220. During processing at steps 212, 214–218, the remaining number N of balls is reduced one by one when transfer of a ball 60 to the arm's cup and pitching of the ball 60 toward the batter's box 20 are detected by the ball transfer sensor 34 and arm sensor 35 respectively, and the pitching machine 30 continues to pitch a ball at the predetermined time interval until the remaining number N of balls becomes "0". When the ball is pitched, the batter's box control circuit 72 executes processing for control of the voice signal generator 44 at steps 213a and 213b to cause the loud speaker 78 to generate a voice of "the pitcher threw a ball" therefrom.

If the pitching arm does not receive any ball 60, the remaining number N of balls is not reduced by processing at steps 212, 220 even if the pitching arm is rotated. When the remaining number N of balls becomes "0", the batter's box control circuit 72 determines a "Yes" answer at step 218 and applies a halt signal to the pitching control circuit 73. This causes the pitching machine 30 to halt pitching of a ball 60.

Subsequently, the batter's box control circuit 72 determines at step 224 whether the mode data MD represents the practice mode or not. If the mode data MD represents the practice mode, the batter's box control circuit 72 determines a "Yes" answer at step 224 and finishes execution of the main program at step 236. As a result, when the practice mode is selected by the batter, the pitching machine 30 is deactivated after pitched a predetermined number (for instance, 15) of balls. In a condition where the power source switch is maintained in its on-position after execution of the main program, the batter's box control circuit 72 restarts execution of the main program at step 200 and waits for insertion of a coin or a pre-paid card.

If the mode data represents the game mode, the batter's box control circuit 72 determines a "No" answer at step 224 and causes the program to proceed to step 226. At step 226, the batter's box control circuit 72 activates a restart timer provided therein and confirms restart of a baseball game by processing at step 228 and 230. That is to say, the batter's box control circuit 72 confirms at step 228 insertion of a coin or the balance of the pre-paid card previously inserted. When a coin is newly inserted or the balance of the pro-paid card exists, the batter's box control circuit 72 determines a "Yes" answer at step 228 and returns the program to step 206 shown in FIG. 19. In this instance, the predetermined fee is subtracted from the balance of the pre-paid card by processing at step 228. Thus, automatic pitching of the predetermined number of balls is restarted without causing interruption of the baseball game described later. If any fresh coin or pre-paid card is not inserted after lapse of a predetermined time T1 (for instance, 30 sec.) from start of the restart timer, the batter's box control circuit 72 determines a "Yes" answer at step 230 and causes the program to proceed to steps 232 and 234. Thus, a result of the game or batting is printed by processing at steps 232 and 234, and execution of the program finishes at step 236 in the same manner as described above.

Figure 22:
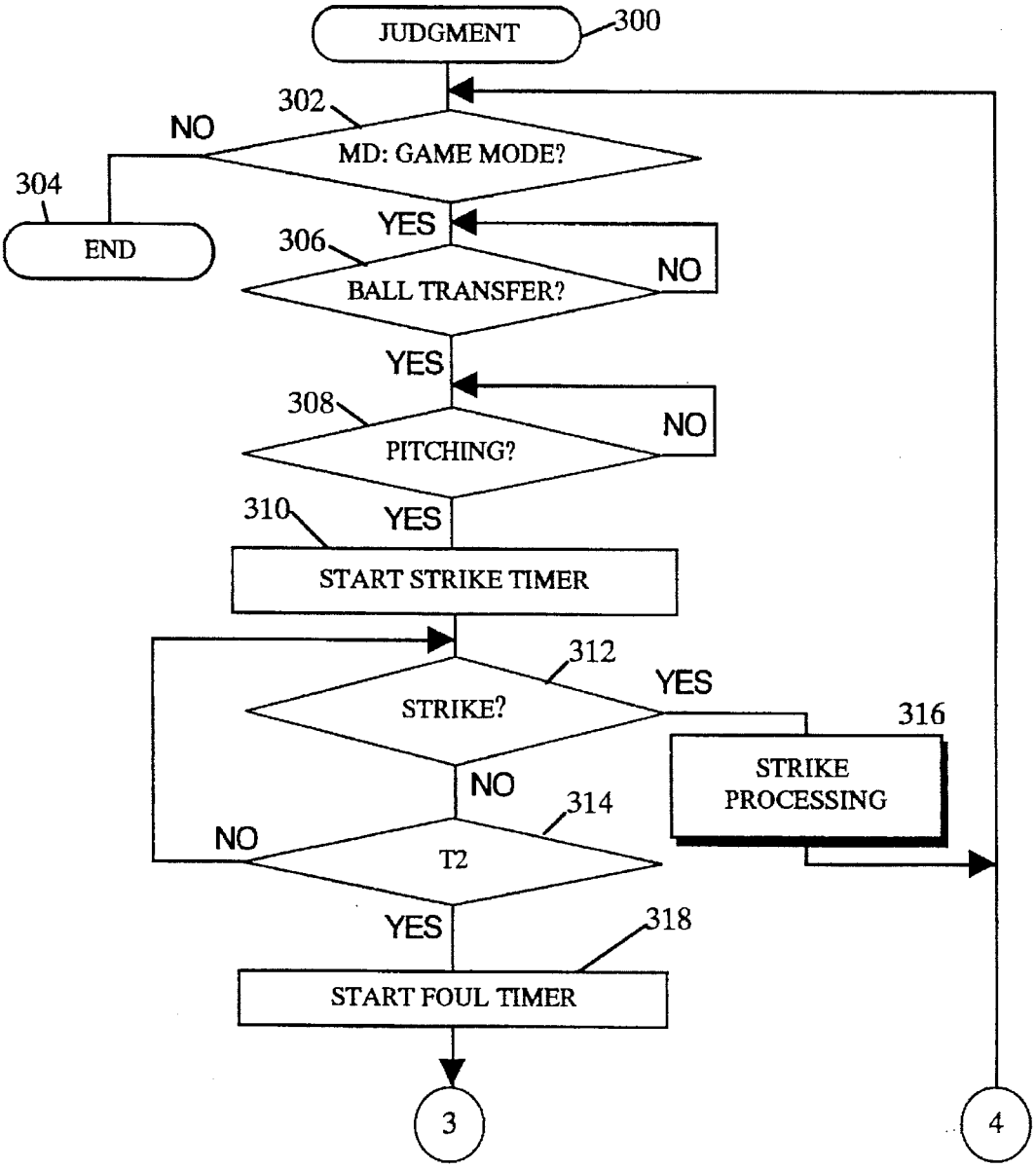
FIG. 22 is a flow chart showing a front half of a game judgment program executed by the batter's box control circuit shown in FIG. 13.
Figure 23:
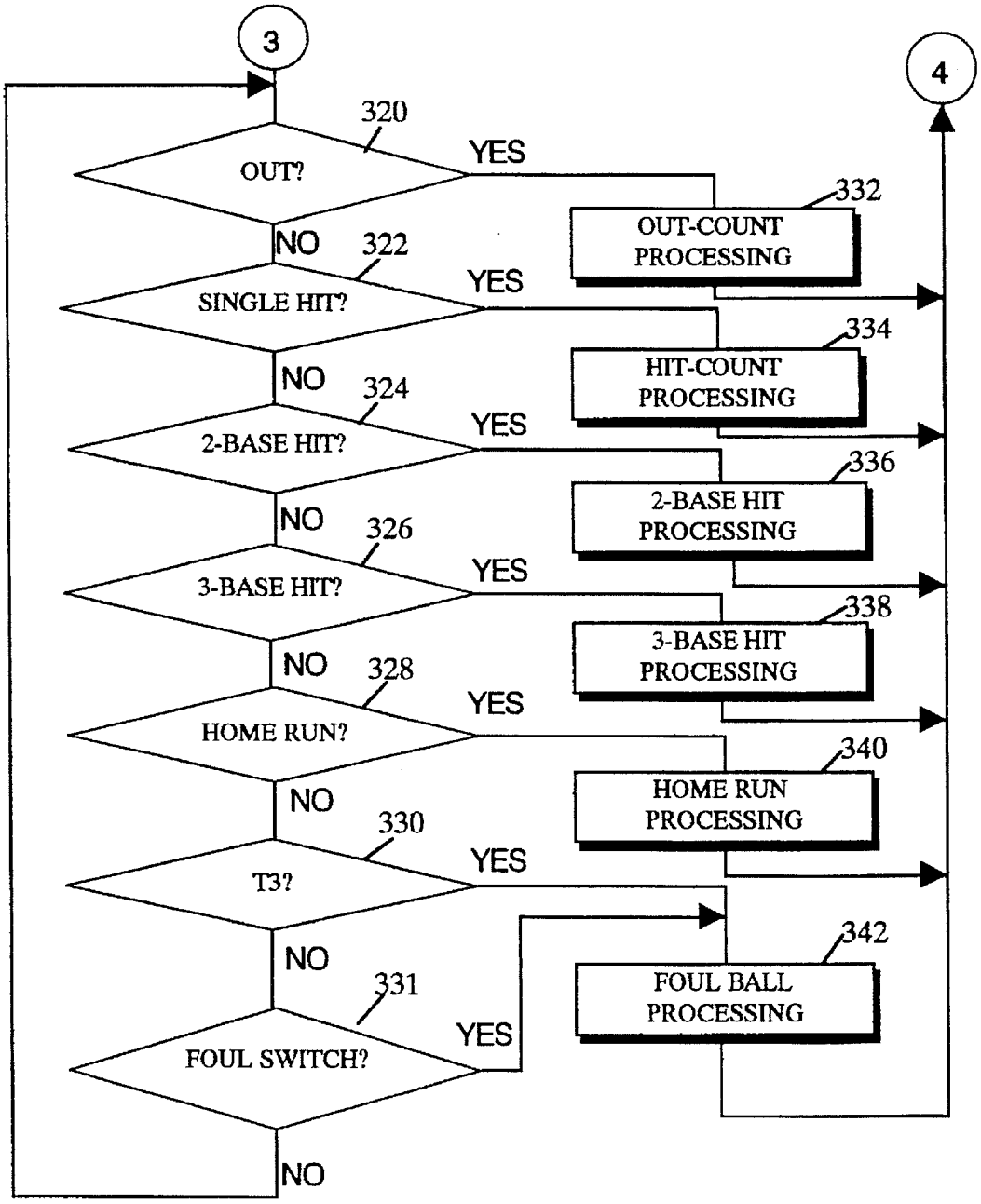
FIG. 23 is a flow chart showing a rear half of the game judgment program.

During execution of the main program, the batter's box control circuit 72 executes a game judgment program shown in FIGS. 22 and 23. The batter's box control circuit 72 starts at step 300 to execute the game judgment program and determines at step 302 whether the mode data MD represents the game mode or not. If the answer at step 302 is "No", the batter's box control circuit 72 finishes execution of the game judgment program at step 304. If the answer at step 302 is "Yes", the batter's box control circuit 72 causes the program to proceed to steps 306 and 308. At steps 306 and 308, the batter's box control circuit 72 becomes responsive to detection signals from the ball transfer sensor 34 and pitching arm sensor 35 to determine whether a ball has been pitched by the pitching machine or not. That is to say, in a condition where a ball has been received by the pitching arm's cup and where the pitching arm has been rotated, the batter's box control circuit 72 determines whether a ball was actually pitched toward the batter's box 20. When the ball was actually pitched, the batter's box control circuit 72 determines a "Yes" answer respectively at steps 306 and 308 and causes the program to proceed to step 310. At step 310, the batter's box control circuit 72.activates a strike timer provided therein and determines at step 312 whether "Strike" has been detected by the strike sensor 24 or not. Subsequently, the batter's box control circuit 72 determines at step 314 whether a predetermined time T2 (for instance, 1.5 sec.) has been measured by the strike timer or not. In a condition where the strike sensor 24 does not detect "Strike" during measurement of the predetermined time T2, the batter's box control circuit 72 continues to determine a "No" answer respectively at steps 312 and 314. When the batter misses a ball pitched by the pitching machine 30, the strike sensor 24 detects the fact that the ball 60 struck the upright board 23. In such an instance, the batter's box control circuit 72 determines a "Yes" answer at step 312 and causes the program to proceed to step 316 for execution of a strike-count processing routine. When the batter hits the ball, the predetermined time T2 elapses without detection of the ball at the strike sensor 24. In such an instance, the batter's box control circuit 72 determines a "Yes" answer at step 314 and causes the program to proceed to step 318. At step 318, the batter's box control circuit 72 activates a foul timer provided therein and causes the program to proceed to step 320 shown in FIG. 23.

Figure 24:
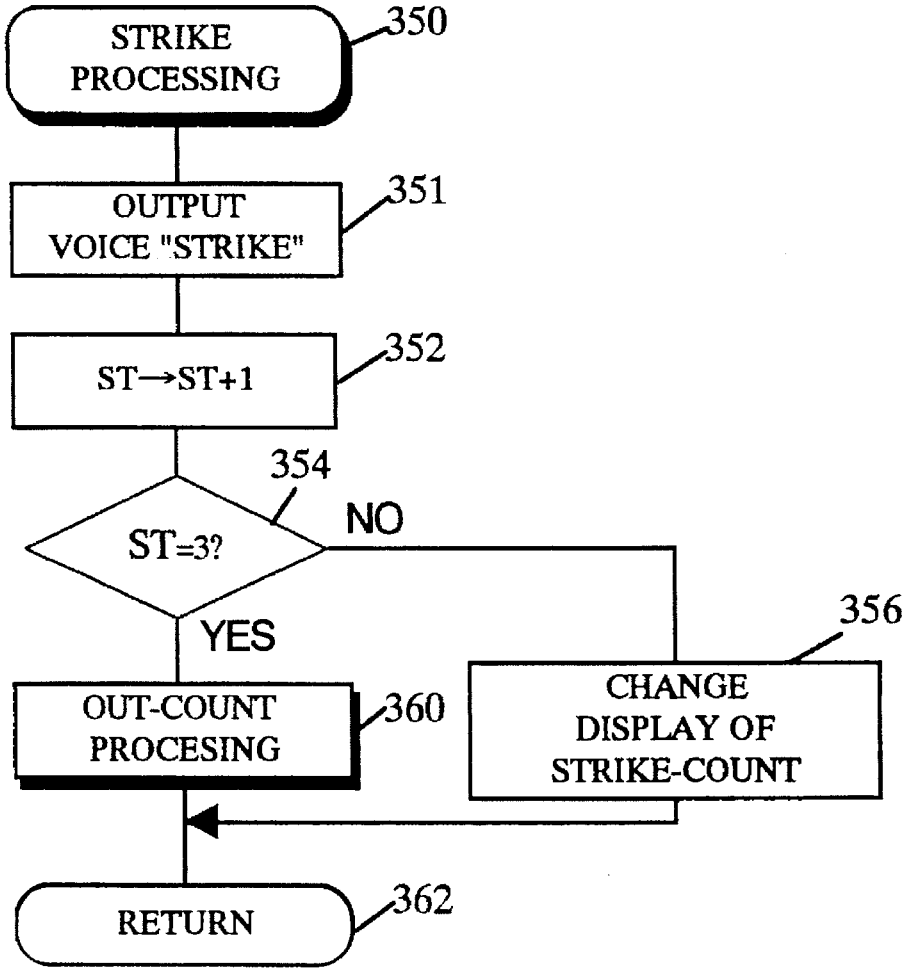
FIG. 24 is a flow chart of a strike processing routine shown in FIGS. 22 and 31.

The strike-count processing routine is shown in detail in FIG. 24. When started at step 350 in FIG. 24 to execute the strike processing routine, the batter's box control circuit 72 controls the voice signal generator 77 at step 351 to cause the speaker 78 to generate a voice of "Strike" therefrom. Subsequently, the batter's box control circuit 77 adds "1" to a strike-count value ST at step 352. The strike-count value ST is initially being set as "0" by initialization (not show). At the following step 354, the batter's box control circuit 72 determines whether the strike-count value ST is "3" or not. If the answer at step 354 is "No", the batter's box control circuit 72 applies the strike-count value ST to the display control circuit 74. When applied with the strike-count value ST, the display control circuit 74 controls the strike-count indicator 36*b* to indicate the strike-count value ST thereon. Simultaneously, the batter's box control circuit 72 controls the strike-count indicator 76*b* on the operation panel 76 to indicate the strike count value ST thereon. After processing at step 356, the batter's box control circuit 72 finishes execution of the strike-count processing routine at step 362. When the strike-count value ST becomes "3" as a result of addition at step 352, the batter's box control circuit 72 determines a "Yes" answer at step 354 and executes an out-count processing routine at step 360. Thereafter, the batter's box control circuit 72 finishes execution of the strike-count processing routine at step 362.

Figure 25:
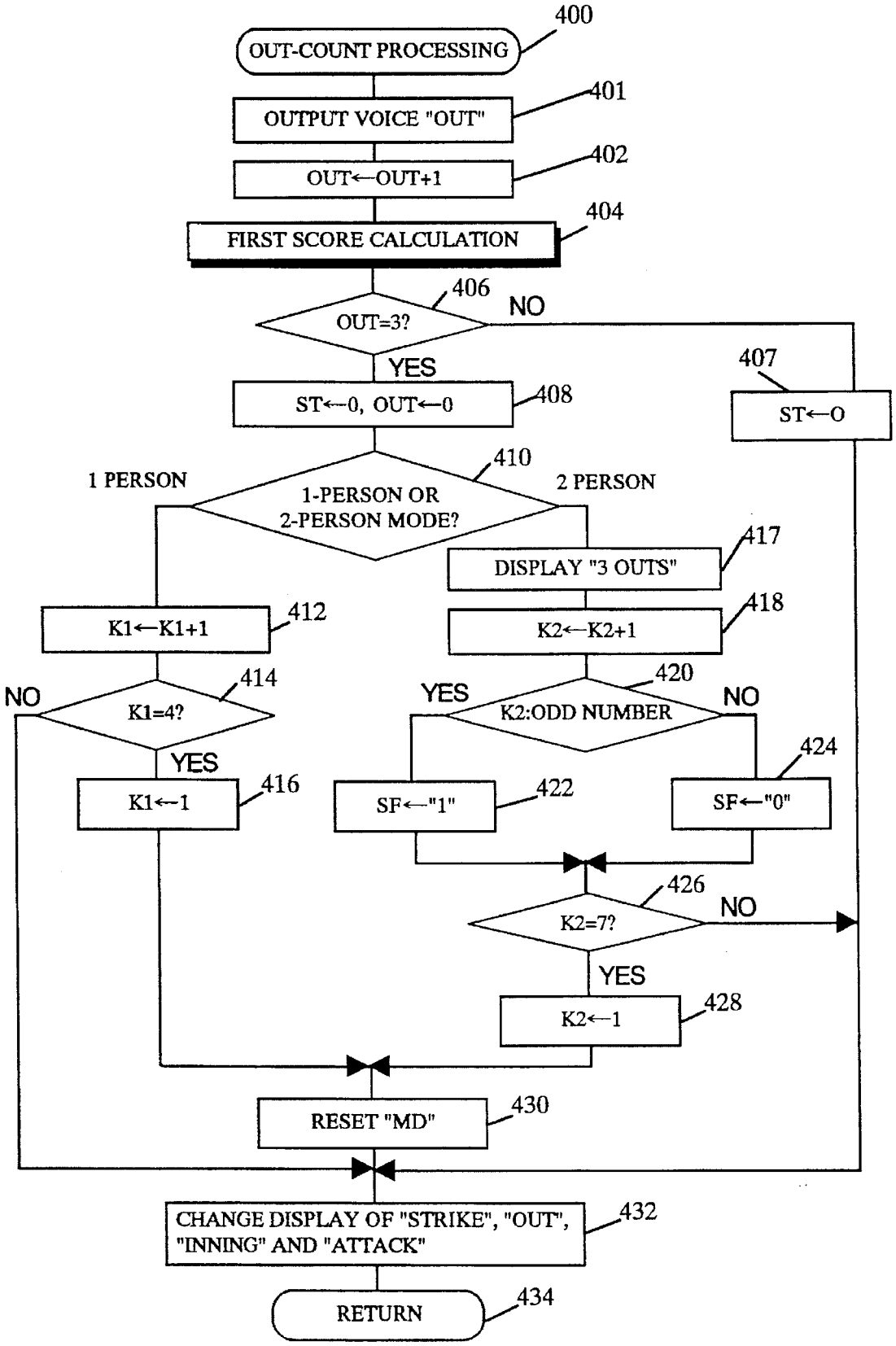
FIG. 25 is a flow chart of an out-count processing routine shown in FIGS. 23, 24 and 31.

The out-count processing routine is shown in detail in FIG. 25. When started at step 401 to execute the out-count processing routine, the batter's box control circuit 72 controls the voice signal generator 77 at step 401 to cause the speaker 78 to generate a voice of "Out" therefrom. In such an instance, the batter's box control circuit 72 adds "1" to an out-count value OUT at step 402 and causes the program to proceed to step 404 for execution of a first score calculation routine shown in detail in FIG. 32. When started at step 620 in FIG. 32 to execute the first score calculation routine, the batter's box control circuit 72 determines at step 622 whether the mode data MD represents the one-person game mode or the two-person game mode and determines at step 624 whether a first attack flag SF represents "First attack" or not. Subsequently, the batter's box control circuit 72 renews at steps 626–636 out-counts OUT1–OUT3 and batting rates AV1–AV3 to be finally printed as a batting score and finishes at step 638 execution of the first score calculation routine. The out-counts and batting rates each are initially being set as "0" together with hit-counts HT1–HT3 by initialization (not shown). The out-counts and batting rates correspond with first and last attacks at the one-person game mode and two-person game mode, respectively.

Assuming that the mode data MD represents the one-person game mode, the batter's box control circuit 72 adds "1" to a first out-count OUT1 at step 626 on a basis of determination at step 622 and calculates at step 628 a ratio of a first hit-count HT1 to a total of the first out-count OUT1 and hit-count HT1 as a first batting rate AV1. When the mode data MD represents the two-person game mode, the batter's box control circuit 72 adds "1" to a second out-count OUT2 at step 630 on a basis of determination at steps 622 and 624 and calculates a ratio of a second hit-count HT2 to a total of the second out-count OUT2 and hit-count HT2 as a second batting rate AV2. When the first attack flag SF represents a last attack in a condition where the mode data MD represents the two-person game mode, the batter's box control circuit 72 adds "1" to a third out-count OUT3 at step 634 on a basis of determination at steps 622 and 624 and calculates a ratio of a third hit-count HT3 to a total of the third out-count OUT3 and hit-count HT3 as a third batting rate AV2.

Referring back to the out-count processing routine shown in FIG. 25, the batter's box control circuit 72 determines at step 406 whether the out-count OUT is "3" or not after processing at step 404. If the answer at step 406 is "No", the batter's box control circuit 72 resets the strike-count ST to "0" at step 407 and applies at step 432 the reset strike-count ST and the out-count OUT added with "1" by processing at step 402 to the display control circuit 74. When applied with the reset strike-count ST and out-count OUT, the display control circuit 74 controls the strike-count indicator 36*b* and out-count indicator 36*c* to indicate the strike-count ST and out-count OUT thereon. Simultaneously, the batter's box control circuit 72 causes the strike-count indicator 76*b* and out-count indicator 76*c* on the operation panel 76 to indicate the strike-count ST and out-count OUT thereon. After processing at step 432, the batter's box control circuit 72 finishes execution of the out-count processing routine at step 434.

When the out-count OUT becomes "3" by processing at step 402, the batter's box control circuit 72 determines a "Yes" answer at step 406 and causes the program to proceed to step 408. Thus, the batter's box control circuit 72 resets the strike-count ST and out-count OUT to "0" respectively at step 408 and determines at step 410 whether the mode data MD represents the one-person game mode or the two-person game mode. If the mode data MD represents the one-person game mode, the batter's box control circuit 72 adds "1" to an inning count value K1 at the one-person game mode at step 412 on a basis of determination at step 410 and determines at step 414 whether the inning count value K1 is "4" or not. The inning count value K1 is initially being set as "1" by initialization (not shown). If the inning count value K1 is not "4", the batter's box control circuit 72 determines a "No" answer at step 414 and causes the program to proceed to step 432. At step 432, the batter's box control circuit 72 applies the strike-count ST, out-count OUT and inning count value K1 reset by processing at step 408 to the display control circuit 74. When applied with the strike-count ST and out-count OUT, the display control circuit 74 controls the strike-count indicator **36*b* and out-count indicator 36*c* to turn off all the indication lamps on the score board 36 and controls the inning indicator 36*d* to indicate the inning count value K1 thereon. Simultaneously, the strike-count indicator 76*b*, out-count indicator 76*c* and liquid crystal indicator 76*d* on the operation panel 76 are controlled by the batter's box control circuit 72 as in the score board 36**.

When the inning count value K1 becomes "4" as a result of processing at step 412, the batter's box control circuit 72 determines a "Yes" answer at step 414 and resets the inning count value K1 to "1" at step 416. This means that the number of innings in one game is determined as "3". When it is desired to change the number of innings in one game to another number, the numeral value determined by processing at step 414 is changed to another value. After processing at step 416, the batter's box control circuit 72 clears the mode data MD at step 430 and causes the printer 75 to print a batting result as will be described in detail later. Subsequently, the batter's box control circuit 72 controls the strike-count indicator **36*b* and out-count indicator 36*c* on the score board 36 at step 432 to turn off all the indication lamps thereof and controls the inning indicator 36*d* to indicate "1" thereon. Simultaneously, the strike-count indicator 76*b*, out-count indicator 76*c* and liquid crystal indicator 76*d* on the operation panel 76 are controlled by the batter's box control circuit 72 as in the score board 36**.

When the mode data MD represents the two-person game mode, the program proceeds to step 417 on basis of determination at step 410. If the first attack flag SF is "1" indicative of a first attack, the batter's box control circuit 72 causes the out-count indicator **36*c* on the score board 36 at step 417 to turn on the three lamps at the first attack side for a predetermine time (for instance, 30 sec.) If the first attack flag SF is "0" indicative of a last attack, the batter's box control circuit 72 causes the out-count indicator 36*c* on the score board 36** to turn on the three lamps at the last attack side for the predetermined time. This allows time for change of the batter at the two-person game mode.

After processing at step 417, the batter's box control circuit 72 adds "1" at step 418 to the inning count value K2 indicative of the number of innings at the two-person game mode and determines at step 420 whether the inning count value K2 is an odd number or not. The inning count value K2 is initially set as "1" by initialization (not shown). If the inning count value K2 is an odd number, the first attack flag SF is set as "1" by processing at step 422 on a basis of determination at step 420. If the inning count value K2 is an even number, the first attack flag SF is set as "0" on a basis of determination at step 420. The first attack flag SF is initially set as "1" by initialization (not shown).

After processing at steps 422 and 424, the batter's box control circuit 72 determines at step 426 whether the inning count value K2 is "7" or not. If the answer at step 426 is "No", the program proceeds to step 432 where the batter's box control circuit 72 controls the strike-count indicator **36*b* and out-count indicator 36*c* on the score board 36 to turn off all the indication lamps thereof. If at step 432 the inning count value K2 is "1" or "2", the display control circuit 74 is applied with "1" as an inning number. If at step 432 the inning count value K2 is "3" or "4", the display control circuit 74 is applied with "2" as an inning number. If at step 432 the inning count value K2 is "5" or "6", the display control circuit 74 is applied with "3" as an inning number. In such an instance, the display control circuit 74 is applied with the first attack flag SF together with the inning number. Thus, the display control circuit 74 turns on the first attack or last attack lamp of the score indicator 36*e* In accordance with the first attack flag SF and causes the inning indicator 36*d* to indicate the inning number applied thereto. Simultaneously, the batter's box control circuit 72 causes the strike-count indicator 76*b*, out-count indicator 76*c* and liquid crystal indicator 76*d* on the operation panel 76 to indicate the inning number as In the score board 36**.

When the inning count value K2 becomes "7", the batter's box control circuit 72 determines a "Yes" answer at step 426 and initializes the inning count value K2 to "1". Although in this embodiment the number of innings for one game is determined as "3", the numeral value used for processing at step 428 may be determined as another value to change the number of innings to another number. After processing at step 428, the batter's box control circuit 72 resets the mode data MD at step 430 and controls the strike-count indicator **36*b* and out-count indicator 36*c* at step 432 to turn off all lamps on the score board 36. The batter's box control circuit 72 also controls the score indicator 36*e* to turn off both the lamps for first and last attacks and controls the inning indicator 36*d* to indicate "1" thereon. Simultaneously, the batter's box control circuit 72 controls the strike-count indicator 76*b*, out-count indicator 76*c* and liquid crystal indicator 76*d* on the operation panel 76 as in the score board 36. Thereafter, the batter's box control circuit 72 finishes execution of the out-count processing routine at step 434**.

When the batter hits a ball, the program proceeds to step 320 shown in FIG. 23. In this instance, the batter's box control circuit 72 executes processing at steps 320–331 to determine whether the batting was "Out", "Single hit", "Two-base hit", "Three base hit", "Home run" or "Foul" and to determine whether the foul switch 26 was turned on by the batter or not. When a ball 60 pitched by the pitching machine 30 is hit by the batter and driven into either one of the hitting zones E1–E10 on the front net 50, the ball 60 rolls on the second and fourth nets 52 and 56 and is introduced to the identifying device 54 or 58. Thus, the identifying device 54 or 58 cooperates with the resonance circuits 62 in the ball 60 to produce an identification signal representing the kind of ball 60 and applies it to the data transfer circuit 71. The data transfer circuit 71 initiates execution of the program shown in FIG. 18 at step 100 and determines a "No" answer at step 102 until it is applied with the identification signal from the identifying device 54 or 58. When applied with the identification signal from the identifying device 54 or 58, the data transfer circuit 71 determines a "Yes" answer at step 102 and causes the program to proceed to steps 104–108.

At step 104, the data transfer circuit 71 determines a batter's box designated by the identification signal and forms a batter's box number data indicative of the batter's box. As step 106, the data transfer circuit 71 determines either one of the hitting zones E1–E10 based on an input position of the identification signal from the identifying device 54 or 58 and forms a hitting zone data defined by the hitting zone into which the ball has been driven. The hitting zone data represents either one of "Out", "Hit", "Two-base hit", "Three-base hit" or "Home run". The hitting zone data representing "Hit", "Two-base hit", "Three-base hit" or "Home run" except for "Out" is called an advanced runner data. At step 108, the batter's box control circuits 72 each are simultaneously applied with the batter's box number data and the hitting zone data. After processing at step 108, the data transfer circuit 71 returns the program to step 102 and executes processing at steps 102–108.

When applied with the batter's box number and hitting zone data, the batter's box control circuit 72 allotted with the batter's box number reads out the hitting zone data and executes processing at steps 320–328 shown in FIG. 23 on the basis of the hitting zone data. If the ball is driven into the hitting zone E2 or E3, the hitting zone data represents "Out". In such an instance, the batter's box control circuit 72 determines a "Yes" answer at step 320 and causes the program to proceed to step 332 for the out-count processing routine. During execution of the out-count processing routine, the strike-count ST, out-count OUT and inning count value K1 are changed as described above to change each display on the score board and operation panel. After execution of the out-count processing routine, the batter's box control circuit 72 returns the program to step 302 shown in FIG. 22 and starts processing for a next ball 60.

Figures 14, 15A, 15B:
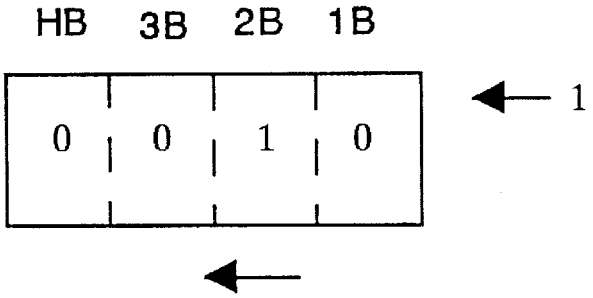
FIG. 14 illustrates an advanced runner register provided in a batter's box control circuit shown in FIG. 13.
FIG. 15(A) illustrates a score register for a one-person game mode provided in the batter's box control circuit shown in FIG. 13.
FIG. 15(B) illustrates a score register for a two-person game mode.

If the ball is driven into the hitting zone E1, the hitting zone data represents "Hit". In such an instance, the batter's box control circuit 72 determines a "Yes" answer at step 322 in FIG. 23 and causes the program to proceed to step 334 for a hit-count processing routine shown in detail in FIG. 26. Thus, the batter's box control circuit 72 starts at step 440 to execute the hit-count processing routine and controls the voice signal generator 77 at step 441 to cause the speaker 78 to generate a voice of "Hit" therefrom. Thereafter, the batter's box control circuit 72 adds "1" to a hit-count value HC at step 442 in FIG. 26. The hit-count value HC is initially being set as "0" by Initialization (not shown). Subsequently, an advanced runner register in the batter's box control circuit 72 is applied with "1" at its lowermost bit and shifts each bit thereof to a higher order one by one. As shown in FIG. 14, the advanced runner register has four bits which correspond with first, second and third bases and a home plate in order from a lowermost order toward a higher order. In the advanced runner register, the presence of "1" represents an advanced state of a runner. All the bits of the advanced runner register each are initially set as "0" by initialization.

Figure 26:
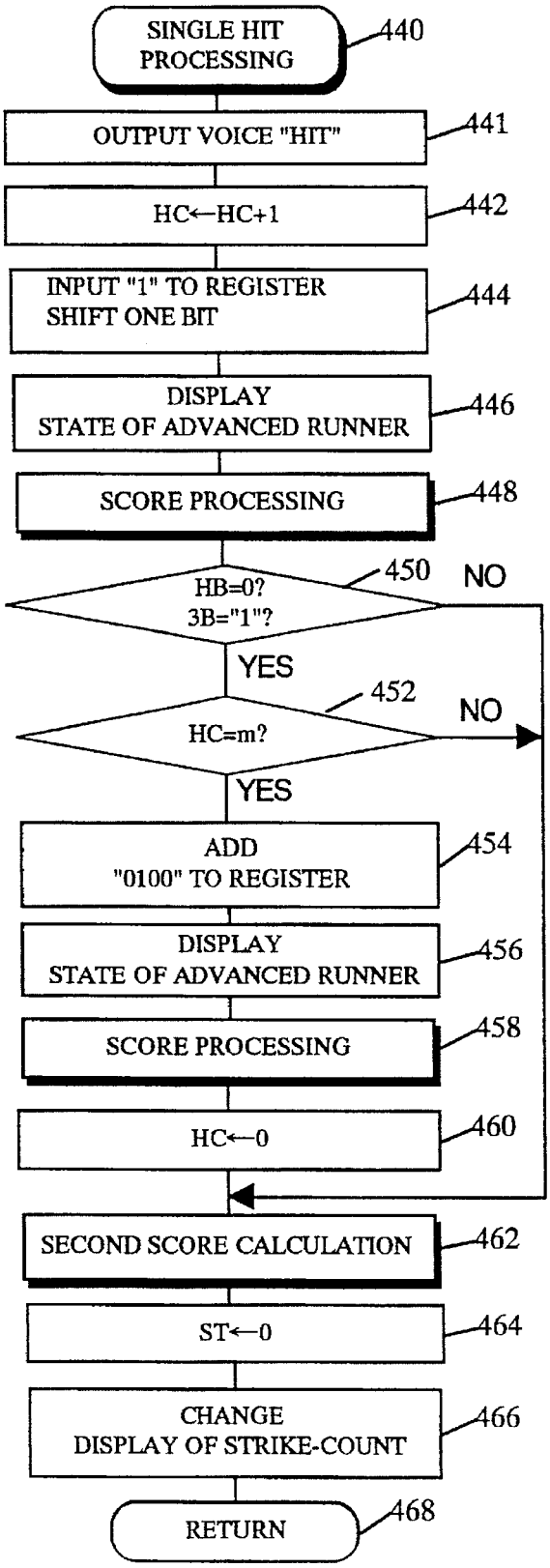
FIG. 26 is a flow chart of a hit-count processing routine shown in FIG. 23.

After processing at step 444 in FIG. 26, the batter's box control circuit 72 applies the contents of the advanced runner register to the display control circuit 74. When applied with the contents of the advanced runner register, the display control circuit 74 causes the advanced runner indicator **36*a* to indicate an advanced state of a runner based on contents of the register previously and newly applied thereto. In this instance, the lamps between the home base and the first base on the score board 36 are successively turned on, and the lamps of the first base are maintained in their energized conditions. When the lamps of the first or second base are turned on in a condition where a runner is present at the first or second base, the lamps are turned off, and in turn, the lamps between the first and second bases or the second and third bases are successively turned on. Thereafter, the lamps of the second or third base are maintained in their energized conditions. When the lamps of the third base are turned on in a condition where a runner is present at the third base, the lamps between the third base and home plate are successively turned on. Thereafter, the lamps of the home plate are turned off after turned on and off several times. At step 446 in FIG. 26, the batter's box control circuit 72 causes the advanced runner indicator 76*a*** on the operation panel to indicate only a result of the advanced state described above.

Figure 30:
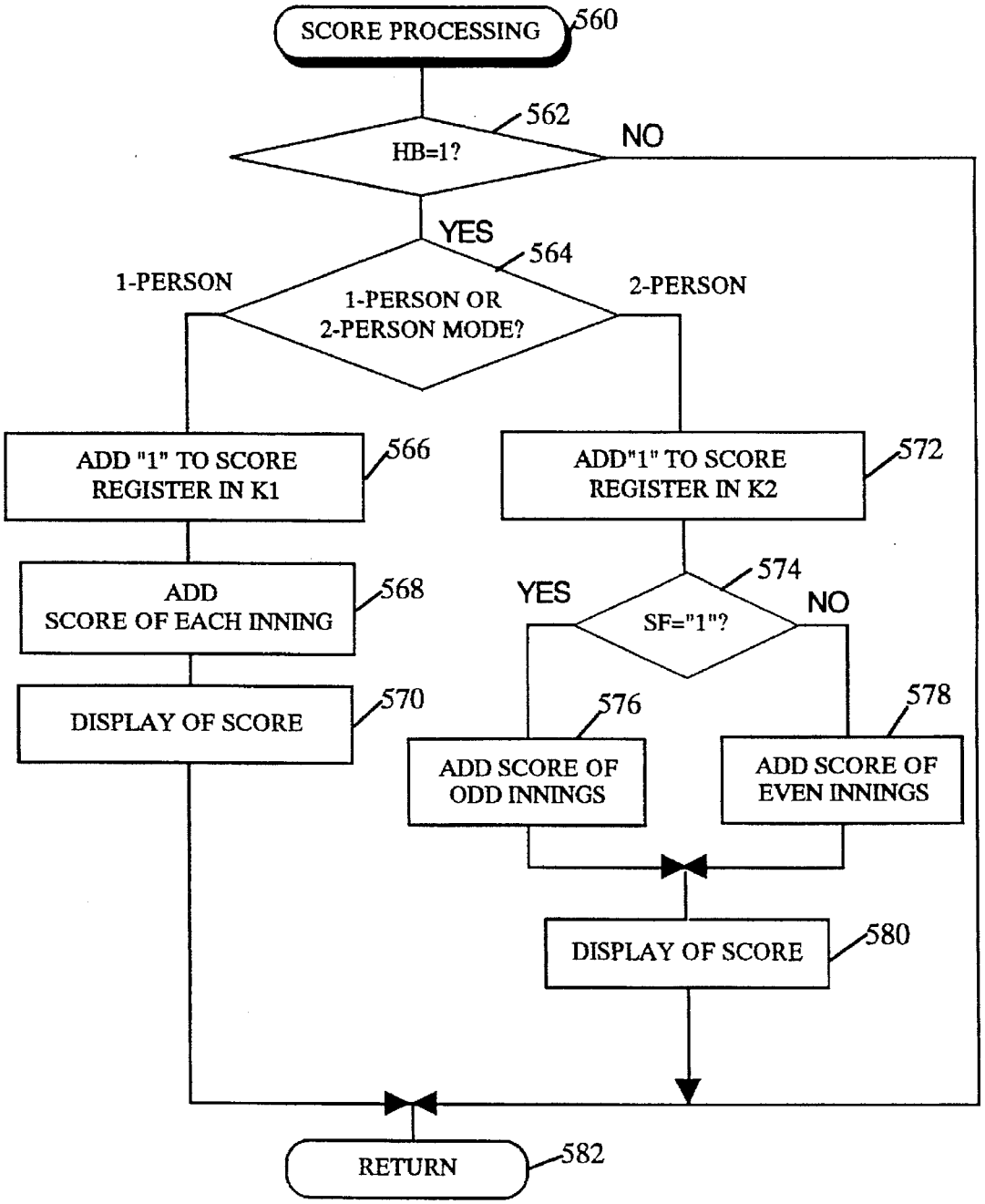
FIG. 30 is a flow chart of a score processing routine shown in FIGS. 26 through 29.

After processing at step 446, the batter's box control circuit 72 executes at step 448 a score processing routine shown in detail in FIG. 30. When execution of the score processing routine at step 560, the batter's box control circuit 72 determines at step 562 whether "1" is present in the highest bit (corresponding with the home plate) of the advanced runner register or not. If "1" is absent in the highest bit, the batter's box control circuit 72 determines a "No" answer at step 562 and finishes execution of the score processing routine at step 582. If "1" is present in the highest bit, the batter's box control circuit 72 determines "Yes" answer at step 562 and causes the program to proceed to step 564 for a score count processing. At step 564, the batter's box control circuit 72 determines whether the mode data MD represents the one-person game mode or the two-person game mode. When the mode data represents the one-person game mode, the batter's box control circuit 72 executes processing at steps 566–570 on a basis of determination at step 564. At step 566, the batter's box control circuit 72 adds "1" to a data in a memory position designated by the inning count value K1 in a score register shown in FIG. 15(A). The score register is arranged to represent first to third innings by data in three higher memory positions and to represent a total score by data in the lowest memory position. These data each are initially being set as "0" by initialization. At step 568 in FIG. 30, the batter's box control circuit 72 adds up the data in the three higher memory positions and memorizes a total of the data as a total score TOTAL in the lowest memory position. At step 570, the total score TOTAL from the score register is transferred to the display control circuit 74 so that the score indicator **36*e* is controlled by the display control circuit 74 to indicate the total score TOTAL on its score column for the first attack. Simultaneously, the batter's box control circuit 72 causes the liquid crystal indicator 76*d* on the operation panel 76** to indicate the total score thereon and finishes execution of the score processing routine.

When the mode data MD represents the two-person game mode, the batter's box control circuit 72 executes processing at steps 572–580 on a basis of determination at steps 564. At step 572, the batter's box control circuit 72 adds "1" to a data in a memory position designated by the inning count value K2 in a score register shown in FIG. 15(B). The score register is arranged to represent each score of the first attack in first to third innings based on data in three higher memory positions of odd numbers, to represent each score of the last attack in first to third innings based on data in three higher memory positions of even numbers and to represent each total score of the first and last attacks based on data in seventh and eighth memory positions. These data each are initially set as "0" by initialization. At step 574 in FIG. 30, the batter's box control circuit 72 determines whether the first attack flag SF is "1" or not. In this instance, the batter's box control circuit 72 executes processing at step 576 if the answer at step 574 is "Yes" and executes processing at step 578 if the answer at step 574 is "No". At step 576, the batter's box control circuit 72 adds up the data in the three higher memory positions of odd numbers and memorizes a total of the data as a total score TOTAL1 of the first attack in the seventh memory position. At step 578, the batter's box control circuit 72 adds up the data in the three higher memory positions of even numbers and memorizes a total of the data as a total score TOTAL2 of the last attack in the eighth memory position. At step 580, each score of the first and last attacks from the score register is transferred to the display control circuit 74 so that the score indicator 36*e* is controlled by the display control circuit 74 to indicate the total scores TOTAL1 and TOTAL2 on each score column for the first and last attacks. Simultaneously, the batter's box control circuit 72 causes the liquid crystal indicator 76*d* on the operation panel 76 to indicate both the total scores TOTAL1, TOTAL2 of the first and last attacks thereon and finishes execution of the score processing routine at step 582.

Referring back to the hit-count processing routine shown in FIG. 26, the batter's box control circuit 72 determines at step 450 whether the data HB of the highest bit (corresponding with the home base) in the advanced runner register is "0" or not and whether the data 3B of the higher second bit (corresponding with the third base) is "1" or not. This is to determine whether or not the batter causes a second base runner to reach the home plate before hitting a single hit in a condition where a runner is absent at the third base. If the answer at step 450 is "No", the program proceeds to step 462 for processing of a second score processing routine. If the answer at step 450 is "Yes", the program proceeds to step 452 where the batter's box control circuit 72 determines whether the hit count value HC added with "1" by processing at step 442 is a predetermined value "m" or not. The predetermined value "m" is an integer of about 2–4. If the answer at step 452 is "No", the program proceeds to step 462. If the answer at step 452 is "Yes", the program proceeds to step 454 where the batter's box control circuit 72 adds a value of "0100" in binary representation to the contents of the advanced runner register. This means that the batter causes a third base runner to reach the home plate. Thus, the batter's box control circuit 72 causes the advanced runner indicators 36*a*, 76*a* on the score board 36 and operation panel 76 to indicate scoring of the third runner thereon and executes the score processing routine as in the same as described above. As a result, "1" is added to a score of the inning designated by the inning count value K1 or K2 and to the total score TOTAL1 or TOTAL2. Thereafter, the batter's box control circuit 72 resets the hit count value HC to "0" and executes the second score calculation routine at step 462. When the hit-count value HC is reset, the second base runner reaches the home plate by a single hit at each inning. This enables the baseball game apparatus to be useful for enjoyment of the baseball game game as in an actual baseball.

Figure 33:
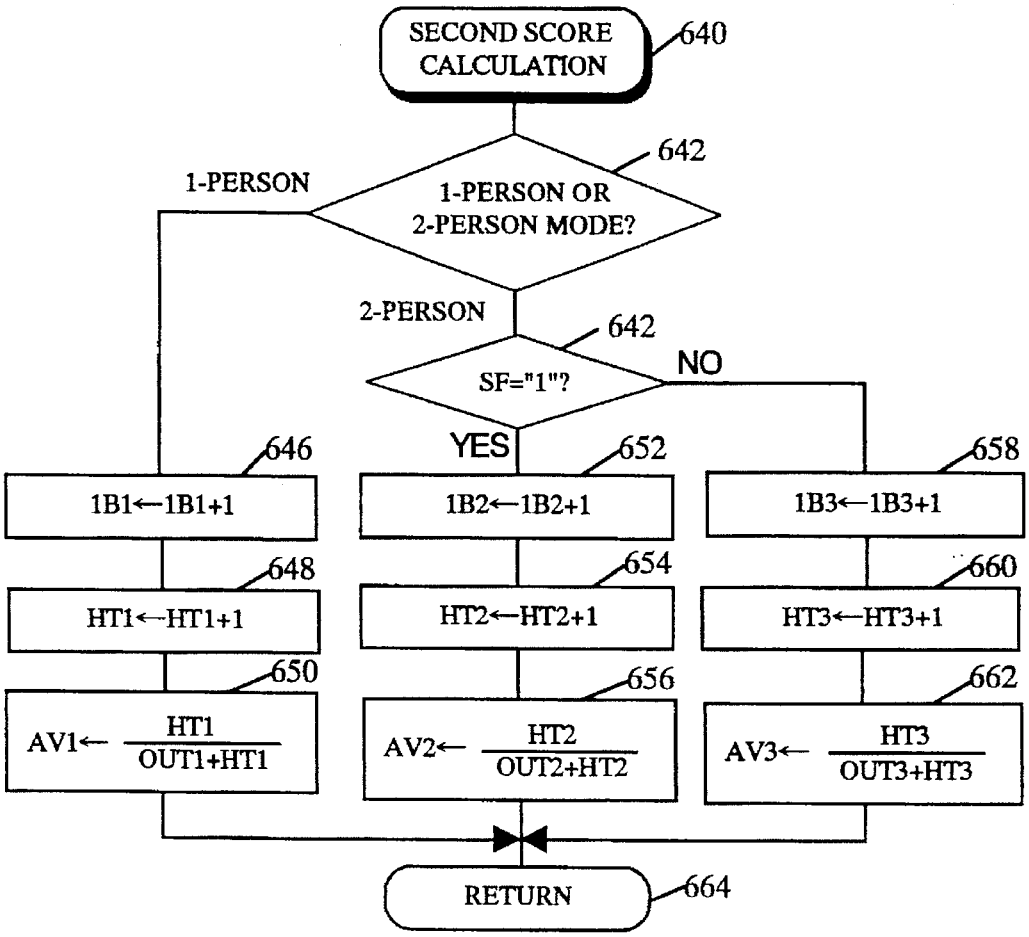
FIG. 33 is a flow chart of a second score calculation routine shown in FIG. 26.
Figure 34:
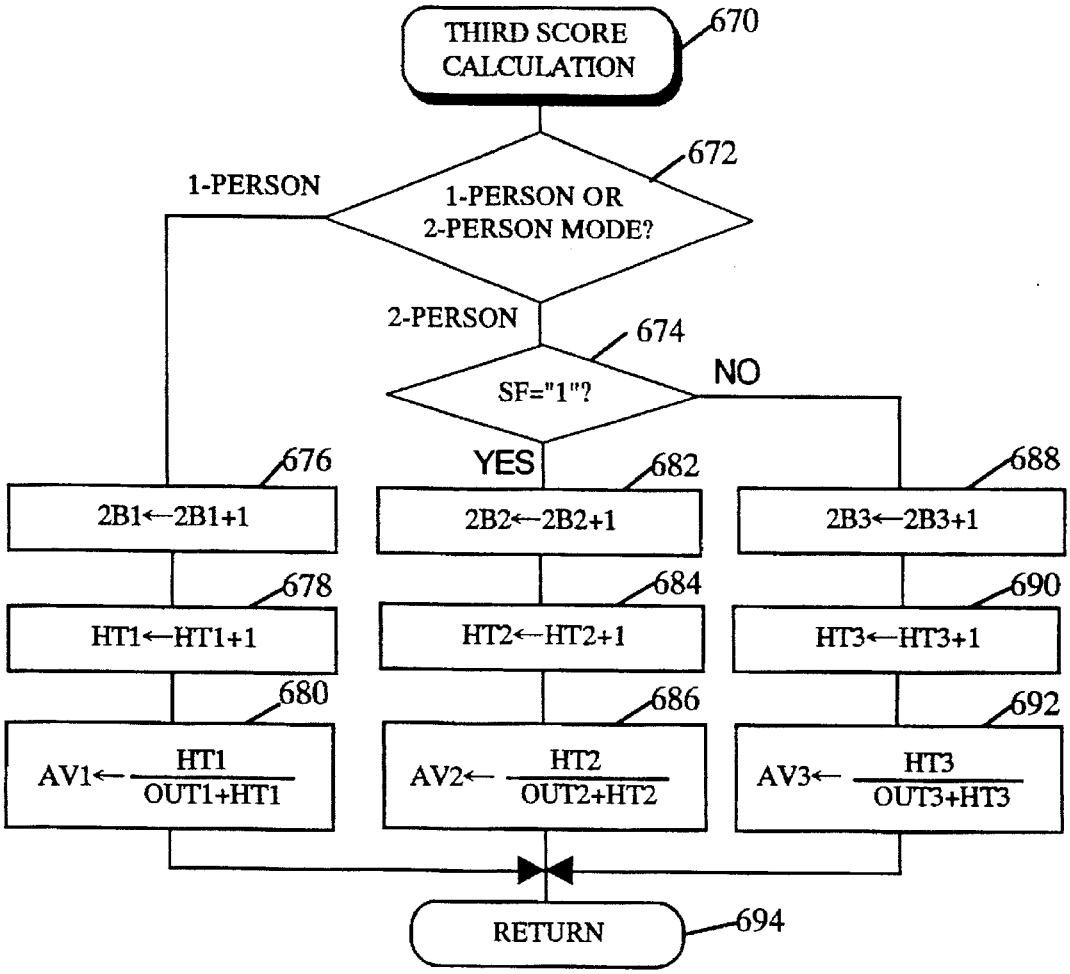
FIG. 34 is a flow chart of a third score calculation routine shown in FIG. 27.

The second score calculation routine at step 462 is shown in detail in FIG. 33. When execution of the second score calculation routine at step 640 shown in FIG. 33 is started, the batter's box control circuit 72 determines the one-person game mode or the two-person game mode at step 642 and determines the first attack or last attack at step 644 in the same manner as in the first score calculation routine. Based on the determination at steps 642 and 644, the batter's box control circuit 72 executes processing at steps 646–662 to add "1" to first to third numbers 1B1–1B3 of single hits and first to third numbers HT1–HT3 of three base hits to be printed as a batting score and to renew the first to third batting rates AV1–AV3. The first to third numbers 1B1–1B3 of single hits are initially set as "0" by initialization (not shown) and correspond with the first and last attacks at the one-person game mode and the two-person game mode.

After execution of the second score calculation routine at step 462 shown in FIG. 26, the batter's box control circuit 72 resets the strike-count value ST to "0" at step 464 and applies the strike-count value ST to the display control circuit 74 at step 466. When applied with the strike-count value ST, the display control circuit 74 turns off each lamp of the strike-count indicator 36*b* on the score board 36. Simultaneously, the batter's box control circuit 72 turns off each lamp of the strike-count indicator 76*b* on the operation panel 76. After processing at step 466, the batter's box control circuit 72 finishes execution of the hit-count processing routine.

Figure 27:
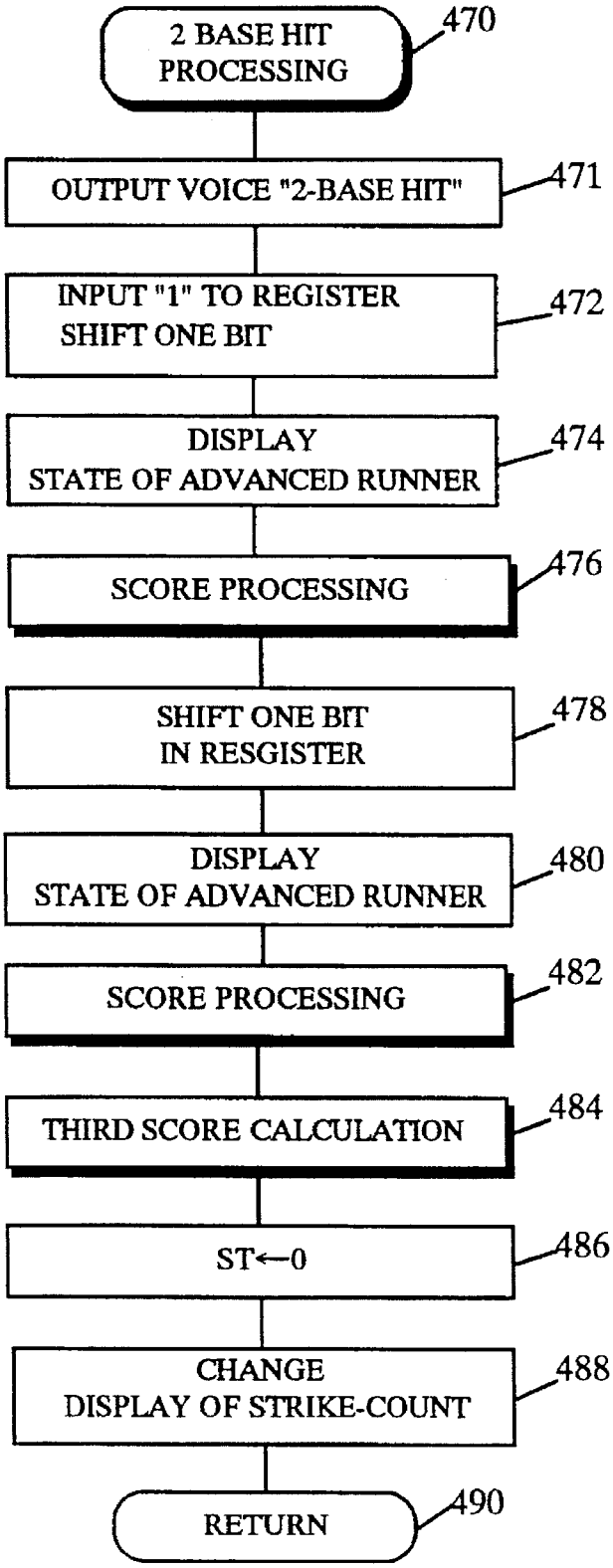
FIG. 27 is a flow chart of a two-base hit processing routine shown in FIG. 23.

Assuming that a ball was driven by a two-base hit of the batter into either one of the batting zones E4, E5, E7, E8, the batter's box control circuit 72 determines a "Yes" answer at step 324 shown in FIG. 23 and causes the program to proceed to step 336 for execution of a two-base hit processing routine shown in detail in FIG. 27. When execution of the two-base hit processing at step 470 is started, the batter's box control circuit 72 controls the voice signal generator 77 at step 471 to cause the speaker 78 to generate a voice of "Two-base hit" therefrom. Subsequently, the batter's box control circuit 72 executes at steps 472, 474 the same processing as that at steps 444, 446 of the hit-count processing routine to advance a runner to the first base and to advance another base runner by one base. In this instance, the advanced state of the runners is indicated by the advanced runner indicators 36*a* and 76*a* on the score board 36 and operation panel 76 under control of the batter's box control circuit 72. At the following step 476, the batter's box control circuit 72 executes the score processing routine described above to renew the score and causes the score indicator 36*e* and liquid crystal indicator 76*d* to indicate the renewed score thereon.

Subsequently, the batter's box control circuit 72 shifts the contents of the advanced runner register by one bit at step 478 to advance each base runner by one base and executes processing at step 480 to display the advanced state of the runners on the advanced runner indicators 36*a* and 76*a*. At the following step 482, the batter's box control circuit 72 executes the score processing routine described above to renew the score and to display the renewed score on the score indicator 36*e* and crystal indicator 76*d*. After processing at step 482, the batter's box control circuit 72 executes at step 484 a third score calculation routine shown in detail in FIG. 34. When execution of the third score calculation routine at step 670 is started, the batter's box control circuit 72 determines the one-person game mode or the two-person game mode at step 672 and determines the first attack or last attack at step 674 in the same manner as in the first and second score calculation routines. Based on the determination at steps 672 and 674, the batter's box control circuit 72 executes processing at steps 676–692 to add "1" to first to third numbers 2B1–2B3 of two-base hits and the first to third numbers HT1–HT3 of three-base hits and to renew the first to third batting rates AV1–AV3. The first to third numbers 2B1–2B3 each are initially set as "0" by initialization (not shown) and correspond with the first and last attacks at the one-person game mode or the two-person game mode. After execution of the third score calculation routine at step 484 shown in FIG. 27, the batter's box control circuit 72 resets the strike-count value ST to "0" at steps 486, 488 in the same manner as in the hit-count processing routine at step 464, 466 and turns off each lamp of the strike-count indicator 36*b* on the score board 36 and each lamp of the strike-count indicator 76*b* on the operation panel 76. Thereafter, the batter's box control circuit 72 finishes execution of the two-base processing routine.

Figure 28:
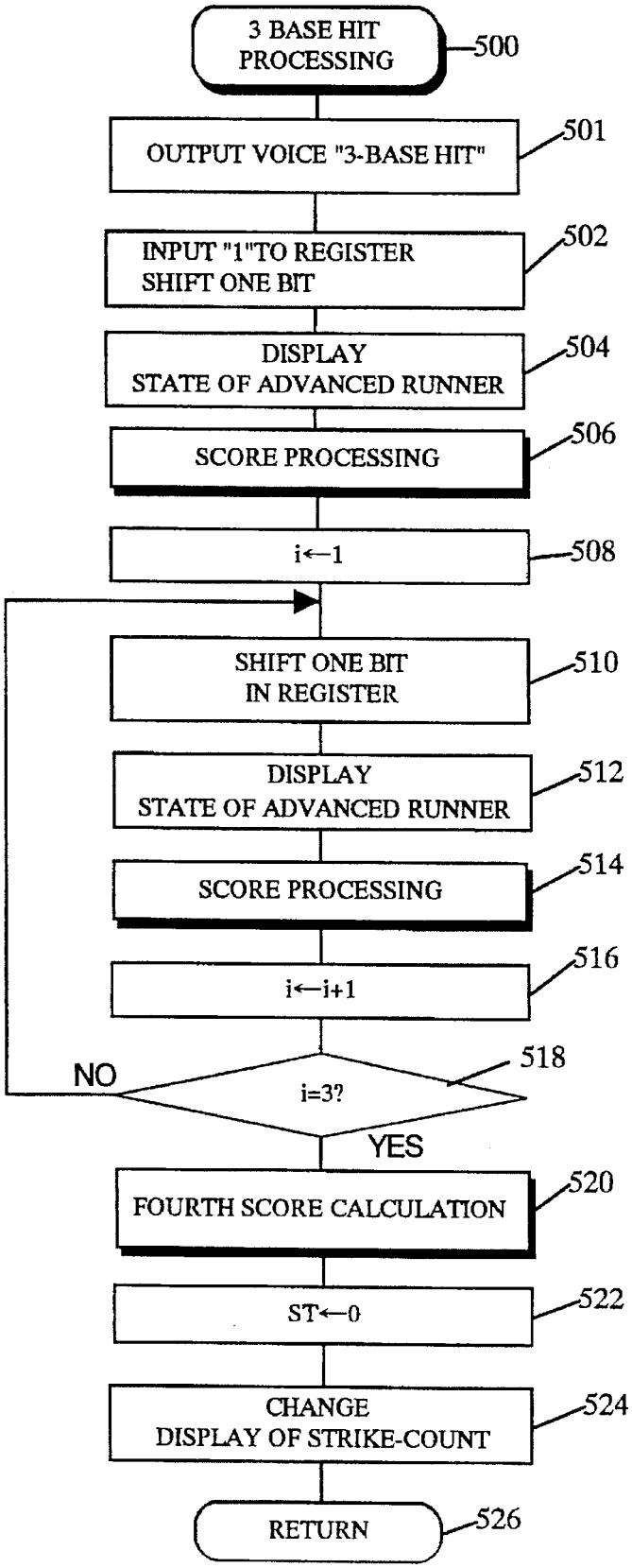
FIG. 28 is a flow chart of a three-base hit processing routine shown in FIG. 23.

Assuming that a ball 60 was driven by a three base hit into either one of the hitting zones E9 and E10, the batter's box control circuit 72 determines a "Yes" answer at step 326 shown in FIG. 23 and causes the program to proceed to step 338 for execution of a three base hit processing routine shown in detail in FIG. 28. When execution of the three base hit processing routine at step 500 is started, the batter's box control circuit 72 controls the voice signal generator 77 to cause the speaker 78 to generate a voice of "Three-base hit" therefrom. Thereafter, the batter's box control circuit 72 executes processing at steps 502–506 in the same manner as in the two-base hit processing routine to advance a runner to the first base and to advance another runner by one base. Thus, the batter's box control circuit 72 causes the advanced runner indicators 36*a*, 76*a* on the score board 36 and operation panel 76 to display the advanced state of the runners thereon and executes the score processing routine to renew the score thereby to indicate the renewed score on the score indicator 36*e* of the score board 36 and the liquid crystal indicator 76*d* of the operation panel 76.

Subsequently, the batter's box control circuit 72 executes processing at steps 508, 516, 518 to increase a variable i from "1" to "3" one by one and executes processing at steps 510–514 two times. The processing at steps 510–514 is the same as that at steps 478–482 of the two-base hit processing routine shown in FIG. 27. With the processing at steps 510–514, the base runners are advanced by two bases, the advanced state of the runners is displayed on the advanced runner indicators 36*a* and 76*a*, and the score processing routine is executed to renew the score thereby to display the renewed score on the score indicator 36*e* and liquid crystal indicator 76*d*. After processing at steps 508–518, the batter's box control circuit 72 executes at step 520 a fourth score calculation routine shown in detail in FIG. 35.

Figure 35:
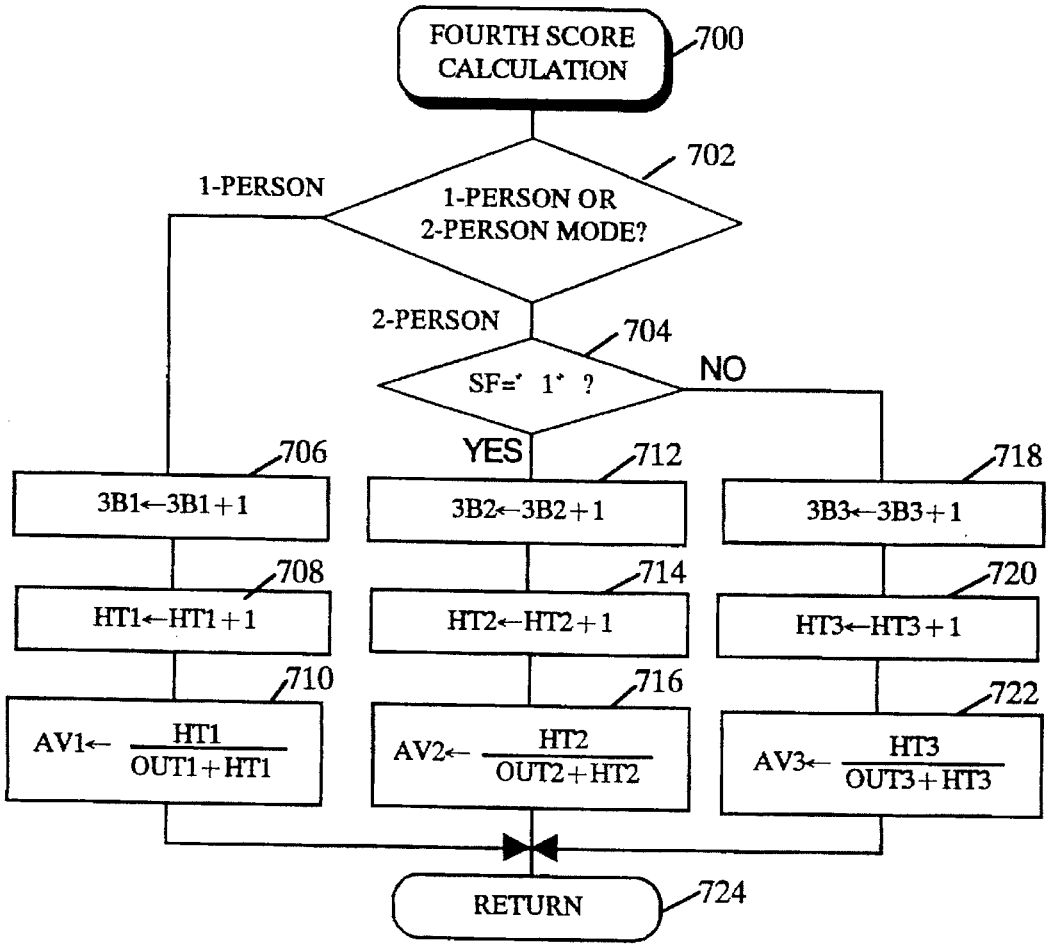
FIG. 35 is a flow chart of a fourth score calculation routine shown in FIG. 28.

When execution of the fourth score calculation routine is started, the batter's box control circuit 72 determines the one-person game mode or the two-person game mode at step 702 shown in FIG. 35 and determines the first attack or last attack at step 704. Based on the determination at steps 702 and 704, the batter's box control circuit 72 executes processing at steps 706–722 to add "1" to the first to third numbers 3B1–3B3 of three-base hits and the first to third numbers HT1–HT3 of single hits to be printed as the batting score and to renew the first to third batting rates AV1–AV3. The first to third numbers 3B1–3B3 of three-base hits each are initially set as "0" by initialization (not shown) and correspond with the first and last attacks at the one-person game mode and the two-person game mode. After execution of the fourth score calculation routine at step 520 shown in FIG. 28, the batter's box control circuit 72 resets the strike-count value ST at steps 522, 524 by the same processing as that at step 464, 466 of the hit-count processing routine and turns off each lamp of the strike-count indicator 36*b* on the score board 36 and each lamp of the strike-count indicator 76*b* on the operation panel 76. Thereafter, the batter's box control circuit 72 finishes execution of the three-base hit processing routine at step 526.

Figure 29:
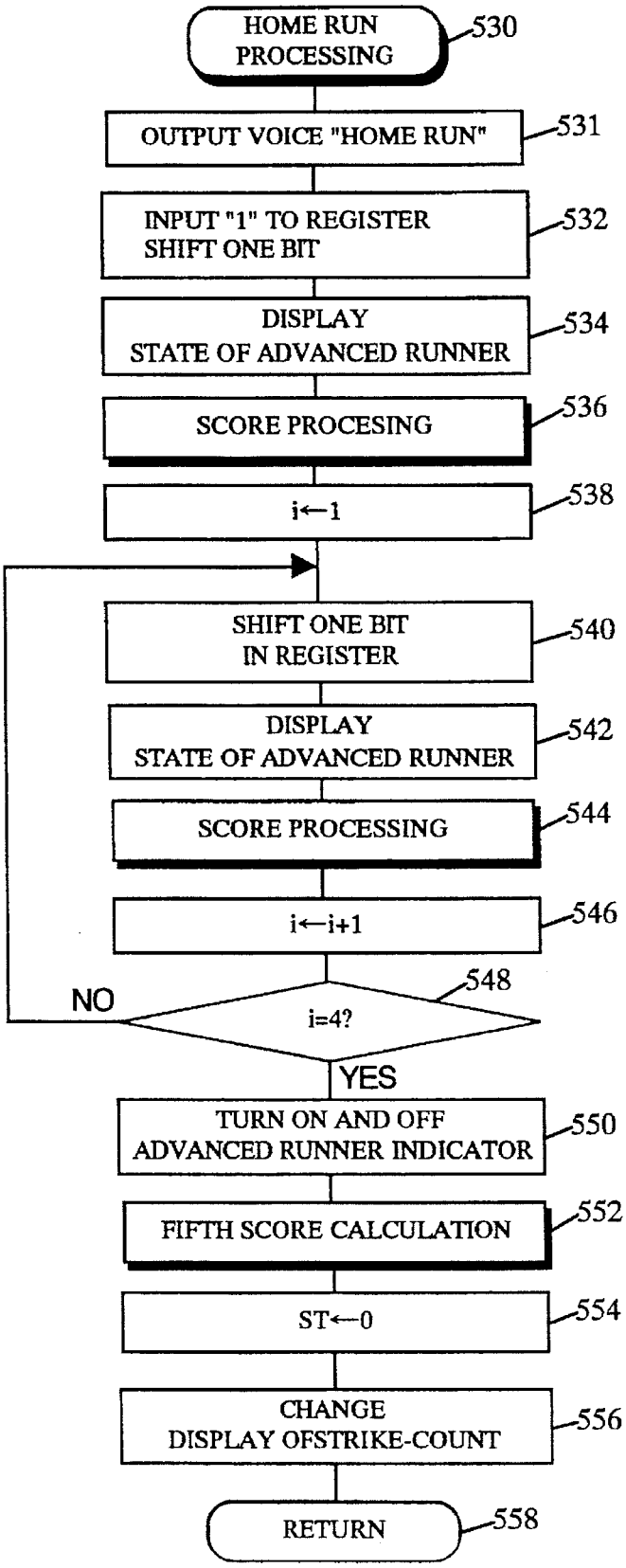
FIG. 29 is a flow chart of a home run processing routine shown in FIG. 23.

Assuming that a ball was driven by a home run into the hitting zone E6, the batter's box control circuit 72 determines a "Yes" answer at step 328 shown in FIG. 23 and causes the program to proceed to step 340 for execution of a home run processing routine shown in detail in FIG. 29. When execution of the home run processing routine at step 530 is started, the batter's box control circuit 72 controls the voice signal generator 77 at step 531 to cause the speaker 78 to generate a voice of "Home run" therefrom. Thereafter, the batter's box control circuit 72 executes processing at steps 532–536 to advance a runner to the first base and to advance another base runner by one base thereby to display the advanced state of the runners on the advanced runner indicators 36*a*, 76*a* of the score board 36 and operation panel 76. In this instance, the batter's box control circuit 72 further executes the score processing routine to renew the score and to display the renewed score on the score indicator 36*e* of the score board 36 and the liquid crystal indicator 76*a* of the operation panel 76.

Figure 36:
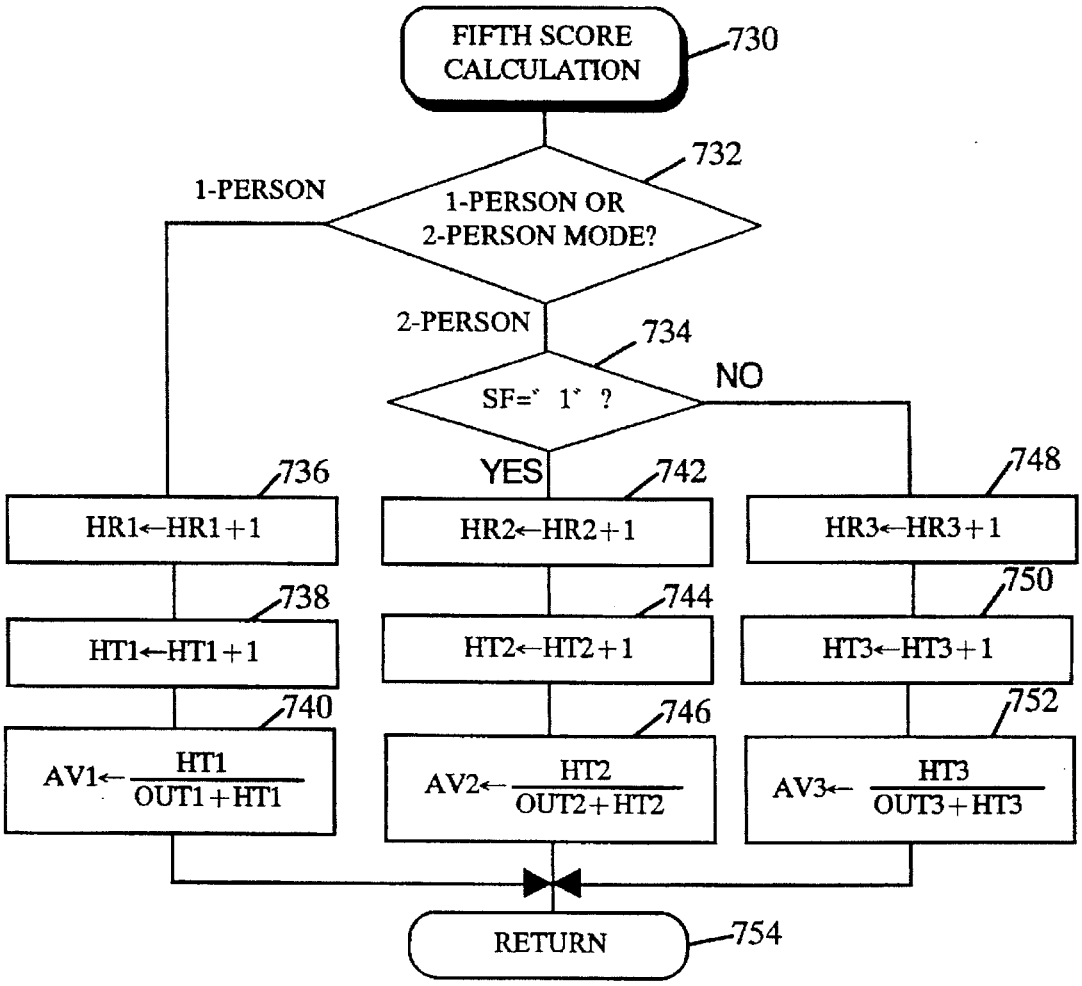
FIG. 36 is a flow chart of a fifth score calculation routine shown in FIG. 29.

Subsequently, the batter's box control circuit 72 executes processing at steps 538, 546, 548 to increase the variable i from "1" to "4" one by one and executes processing at steps 540–544 three times. The processing at steps 540–544 is the same as that at steps 478–482 of the two-base hit processing routine shown in FIG. 27. With the processing at steps 540–544, the base runners each are advanced by three bases, the advanced state of the runners is displayed on the advanced runner indicators 36*a*, 76*a* on the score board 36 and operation panel 76, the score processing routine is executed to renew the score, and the renewed score is displayed on the score indicator 36*e* of the score board 36 and the liquid crystal indicator 76*d* of the operation panel 76. After processing at steps 538–548, an on-and-off signal is applied to the display control circuit 74 by processing at step 550. When applied with the on-and-off signal, the display control circuit 74 causes each lamp of the advanced runner indicator 63*a* on the score board 36 to turn on and off for a short time to inform the batter of the home run. At the following step 550, the batter's box control circuit 72 executes a fifth score calculation routine shown in detail in FIG. 36. When execution of the fifth score calculation routine at step 730 in FIG. 36 is started, the batter's box control circuit 72 determines the one-person game mode or the two-person game mode at step 732 and determines the first attack or last attack at steps 734. Based on the determination at step 732 and 734, the batter's box control circuit 72 executes processing at steps 736–752 to add "1" to the first to third numbers HR1–HR3 of home runs and the first to third numbers HT1–HT3 of three-base hits to be printed as the batting score and to renew the first to third batting rates AV1–AV3. The first to third numbers HR1–HR3 of home runs each are set initially as "0" by initialization (not shown) and correspond with the one-person game mode and the two-person game mode. After execution of the fifth score calculation routine at step 552 shown in FIG. 29, the batter's box control circuit 72 resets the strike-count value ST to "0" at steps 554, 556 by the same processing as that at steps 464, 466 of the hit-count processing routine and turns off each lamp of the strike-count indicators 36*b* and 76*b*. At the following step 558, the batter's box control circuit 72 completes execution of the home run processing routine.

Assuming that a ball hit by the batter is foul, the batter's box control circuit 72 is not applied with any advance data indicative of either "Out", "Hit", "Two-base hit", "Three-base hit" or "Home run" from the data transfer circuit 71 during execution of processing at steps 320–331 shown in FIG. 23. Thus, when a predetermined time T3 (for instance 5.5 sec.) is measured by a foul timer by processing at step 318 shown in FIG. 22, the batter's box control circuit 72 determines a "Yes" answer at step 330 in FIG. 23 and causes the program to proceed to step 342 for execution of a foul processing routine. That is to say, if a ball 60 pitched by the pitching machine 30 is not be driven into the hitting zones E1–E10 without detection at the strike sensor 24, the ball is judged as a foul ball. Accordingly, the time T3 is determined to be shorter than a pitching interval of the pitching machine 30 and longer than a time during which a ball driven into either one of the hitting zones E1–E10 is identified by the identifying devices 54, 58. In this instance, the ball hit by the batter rolls on the floor 11 in the dome 10 and is received by the ball supplying device 40.

In the case that the ball 60 is not driven into any one of the hitting zones E1–E10 as described above, the foul switch 26 may be turned on by the batter's bat or foot. In such an instance, the batter's box control circuit 72 determines a "Yes" answer at step 331 in FIG. 23 during processing at steps 320–331 and causes the program to proceed to step 342 for execution of the foul processing routine.

Figure 31:
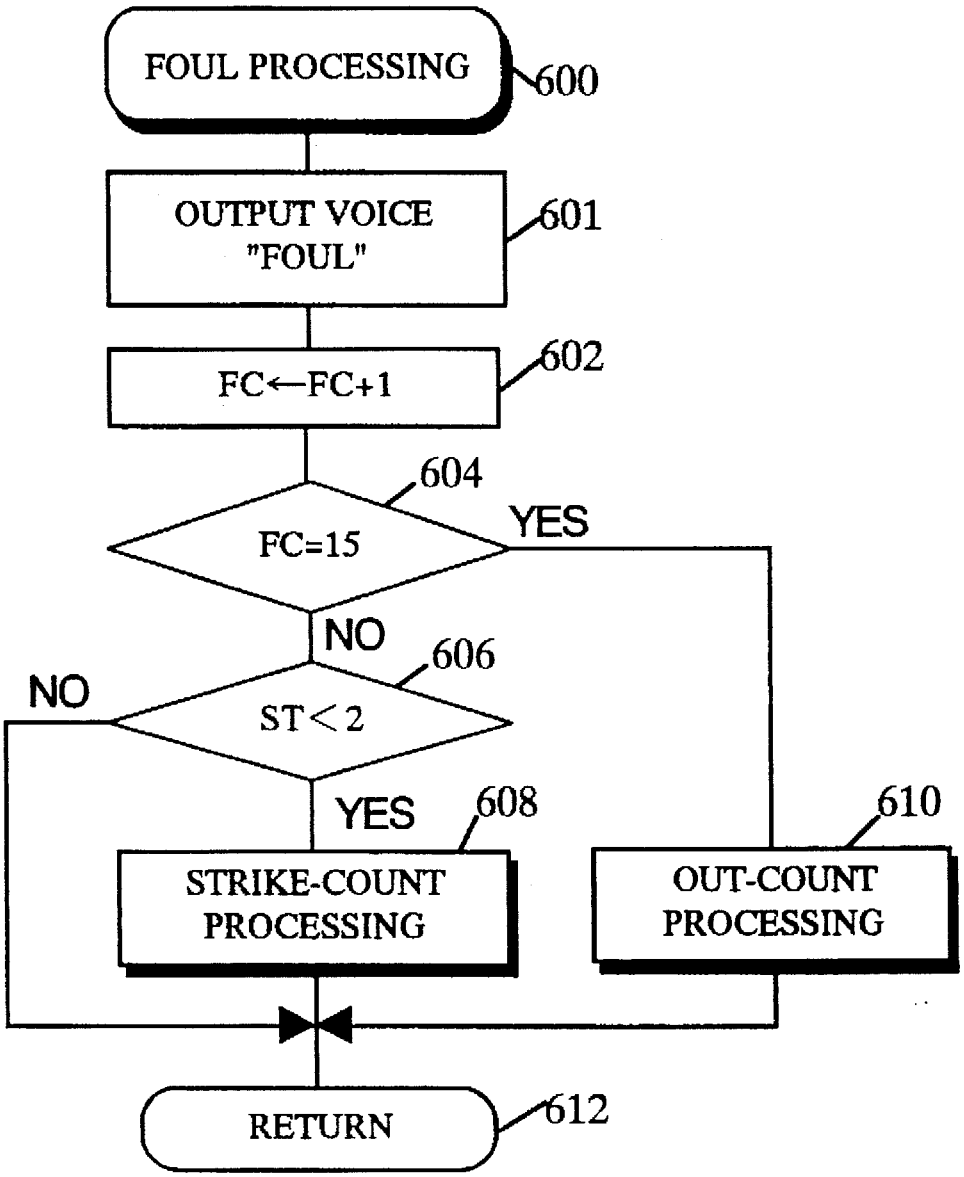
FIG. 31 Is a flow chart of a foul ball processing routine shown in FIG. 23.
Figure 32:
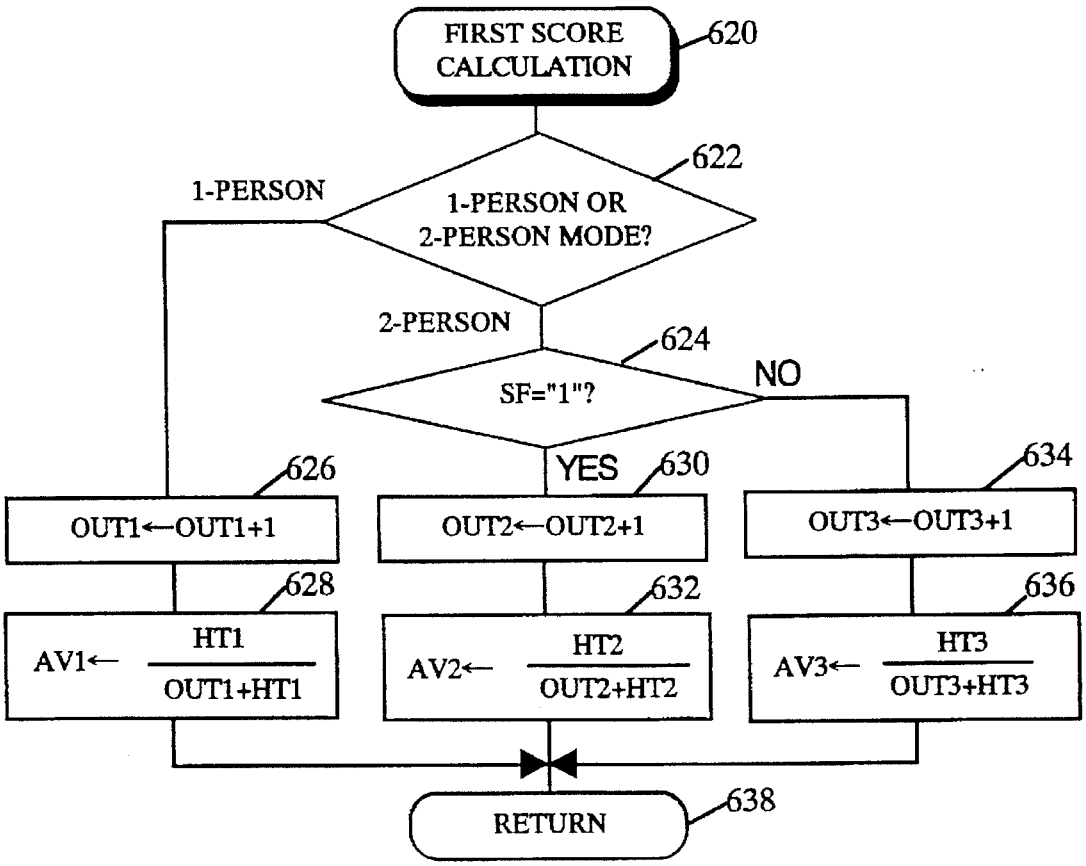
FIG. 32 is a flow chart of a first score calculation routine shown in FIG. 25.

The foul processing routine at step 342 is shown in detail in FIG. 31. When execution of the foul processing routine at step 600 in FIG. 31 is started, the batter's box control circuit 72 controls the voice signal generator 77 at step 601 to cause the speaker 78 to generate a voice of "Foul" therefrom. At the following step 602, the batter's box control circuit 72 adds "1" to a foul-count value FC at step 602 and determines at step 604 whether the foul-count value FC is "15" or not. The foul-count value FC is initially set as "0" by initialization (not shown). If the answer at step 604 is "No", the program proceeds to step 606 where the batter's box control circuit 72 determines whether the strike-count value ST is less than "2" or not. If the strike-count value ST is less than "2", the batter's box control circuit 72 determines a "Yes" answer at step 606 and executes the strike-count processing routine shown in detail in FIG. 24. During execution of the strike-count processing routine, "1" is added to the strike-count value ST by processing at step 352 in FIG. 24. Since the strike-count value ST does not become "3", the batter's box control circuit 72 executes processing at step 356 based on determination at step 354 to renew the display of the strike-count indicators **36*b* and 76*b* in accordance with the strike count value ST added with "1" as described above. After processing at step 608 in FIG. 31, the batter's box control circuit 72 completes execution of the foul-count processing routine at step 612**.

When the foul-count value FC becomes more than "2" by processing at step 602, the batter's box control circuit 72 determines a "No" answer at step 606 and finishes execution of the foul processing routine at step 612. As a result, the strike-count value ST is maintained as "2". When the foul-count value FC becomes "15", the batter's box control circuit 72 determines a "Yes" answer at step 604 and executes the out-count processing routine of FIG. 25 at step 610. Thereafter, the batter's box control circuit 72 finishes execution of the foul processing routine at step 612. In this instance, the out count OUT increases by "1".

When the inning count value K1 becomes "4" during progress of the baseball game at the one-person game mode, the mode data MD is reset by processing at steps 414, 430 shown in FIG. 25. When the inning count value K2 becomes "7" during progress of the baseball game at the two-person game mode, the mode data MD is reset by processing at steps 426, 430 shown in FIG. 25. As a result, the batter's box control circuit 72 determines a "Yes" answer at step 210 shown in FIG. 19 and causes the program to proceed to step 238.

At step 238, the batter's box control circuit 72 activates the printer 75 to print a result of the baseball game and batting score on a paper. In the case that the baseball game was played at the two-person game mode, the contents of the score register for two persons (see FIG. 15(B)) are read out so that each score of the first to third innings and the total score are printed on columns divided into the first and last attacks as shown in FIG. 37. In this instance, as shown in FIG. 37, the batting rates AV2, AV3, the numbers HR2, HR3 of home runs, the numbers 1B2, 1B3 of single hits, the numbers 2B2, 2B3 of two-base hits and the numbers 3B2, 3B3 of three-base hits are printed on columns divided into the first and last attacks, and the total scores of the first and last attacks are also printed as RBI at the first and last attacks. In the case that the baseball game was played at the one-person game mode, the contents of the score register for one-person (see FIG. 15(A)) are read out so that each score of the first to third innings and the total score are printed. In this instance, the batting rate AV1, the numbers HR1 of home runs, the numbers 1B1 of single hits, the numbers 2B1 of two-base hits and the numbers 3B1 of three-base hits are printed, and the total score is printed as RBI.

After processing at step 238 in FIG. 19, the batter's box control circuit 72 resets at step 240 the variables and data used in the foregoing programs except for the remaining value N and determines at step 242 whether the remaining value N is "0" or not. If the remaining value N is "0", the batter's box control circuit 72 determines a "Yes" answer at step 242 and causes the program to proceed to step 222. If the answer at step 242 is "No", the program proceeds to step 243 where the batter's box control circuit 72 applies a halt signal to the pitching control circuit 73 to deactivate the pitching machine 30. At the following step 244, the batter's box control circuit 72 executes the mode switch routine in the same manner as in start of the main program. Thereafter, the program proceeds to step 208 where the pitching machine 30 is activated under control of the batter's box control circuit 72 to restart pitching of balls.

In a condition where insertion of a coin or a pre-paid card with balance are waited at steps 228, 230 shown in FIG. 20, the batter's box control circuit 72 executes processing at step 232, 234 while the predetermined time T1 is measured by the restart timer. At step 232, a result of a game and batting score is printed in the same manner as in the processing at step 238, provided that only an interim result of the game is printed. At step 234, the variables and data are reset as in the processing at step 240, and the execution of the main program finishes at step 236.

As is understood from the above description, the pitching machines 30 each are automatically supplied with the same kind of balls to pitch the balls 60 toward the respective batter's boxes 20 at the predetermined time interval. The pitched ball is hit by the batter and identified by the identifying device 54 or 58 when driven into either one of the hitting zones E1–E10. When applied with the identification signal from the identifying device 54 or 58, the data transfer circuit 71 determines the batter's box where the ball has been hit and judges the advanced number of each runner defined by "Out", "Hit", "Two-base hit". "Three-base hit" or "Home run" in dependence upon the identification signal from the identifying device 54 or 58. If the batter misses the ball 60 pitched by the pitching machine 30, the ball 60 strikes the upright board 23 and is detected by the strike sensor 24 so that the batter's box control circuit 72 judges "Strike" in response to a detection signal applied thereto from the strike sensor 24. When the advanced number of each runner or the "Strike" has not been judged within the predetermined time, the batter's box control circuit 72 judges "Foul". When the foul switch 26 has been turned on by the batter, the batter's box control circuit 72 also judges "Foul".

Based on the judgment described above, a voice signal indicative of a result of judgment is issued from the voice signal generator 77 through the speaker 78 under control of the batter's box control circuit 72. The batter's box control circuit 72 calculates a strike-count, an out-count, the number of innings, an advanced state of runners and a score at each of the batter's boxes to display them on the score board 36 and operation panel 76. The batter's box control circuit 72 further controls the printer to print the batting rate, RBI, and the numbers of home runs, single hits, two-base hits, three-base hits. The calculation, display and print are carried out for two persons or one person in accordance with selection of the mode data. Accordingly, the batter can enjoy the environment of a baseball game as in an actual baseball game by batting bails automatically pitched from the pitching machine 30.

Although in the above embodiment, a pair of resonance circuits have been contained within each ball to identify the kind of ball, identification information may be provided on the balls with a bar-code or magnetic ink to identity the balls in kind to be supplied to the pitching machines 30. Alternatively, the identifying devices 54, 58 may be arranged to identify the balls in kind.

Although in the above embodiment, the batting rate, RBI, the numbers of home runs, signal hits, two-base hits and three-base hits are printed, these data may be displayed on the score board 36 and operation panel 76. Although in the present embodiment, the strike-count, out-count, the number of innings, the advanced state of runners and the score are displayed while the batting rate, RBI, and the numbers of home runs, single hits, two-base hits and three-base hits are printed, this data may be partly displayed or printed.

Although in the above embodiment, the batting zones for "Out", "Hit", "Two-base Hit", "Three-base Hit" and "Home Run" are provided in front of the batter's boxes, a foul zone may be provided. Although in the above embodiment, all the batter's boxes 20 have been arranged for enjoyment of the baseball game in the dome 10, the batter's boxes 20 may be partly arranged for enjoyment of the baseball game. In the case that only one of the batter's boxes is arranged for enjoyment of the baseball game, identification of the balls becomes unnecessary.

What is claimed is:

1. A baseball game system used in a batting practice range where a pitching machine is installed to automatically pitch a ball toward a batter's box, wherein a from net installed in front of said batter's box is subdivided to form an advanced runner zone for a single hit zone, a two-base hit zone, a three-base hit zone, a home run zone and an out zone, and wherein said baseball game system comprises:

hitting zone detecting means for detecting a ball driven into said advanced runner zone or the out zone from said batter's box;

strike counting means including an upright board installed behind said batter's box and provided with a strike sensor for detecting a ball pitched by said pitching machine striking the upright board due to a batter missing said pitched ball and means for increasing a strike-count in response to detection of said strike sensor for judgment of "out" when said strike count becomes a predetermined value;

out counting means for increasing an out-count when an "Out" is judged by said strike counting means or has been detected by said hitting zone detection means based on a ball being driven into said out zone, said out counting means further being for progressing first and last attacks in each inning and resetting the out-count when said out-count becomes a predetermined value;

an electric control portion including score counting means for counting a number of advanced runners detected by said hitting zone detection means based on a ball being driven into the advanced runner zone, for calculating an advanced state of runners in each inning based on a counted number of advanced runners and for counting a number of scoring runners as a score;

inning counting means for counting a number of game innings; and display means connected to said strike counting means, said out counting means and said score counting means to display the strike-count, the out-count, progress of the innings and the score.

2. A baseball game system as set forth in claim 1, further comprising a pitching sensor for detecting a ball pitched by said pitching machine, wherein said electric control portion includes judgement means for judging a ball hit by the batter as "Foul" if said strike sensor or said hitting zone detecting means does not detect any ball within a predetermined time after detecting of a ball at said pitching sensor, and wherein said strike counting means increases the strike-count in response to judgement of "Foul" by said judgment means.

3. A baseball game system as set forth in claim 1, further comprising printing means for printing a score of each inning counted by said score counting means.

4. A baseball game system as set forth in claim 1, wherein said electric control portion includes pitching control means for controlling said pitching machine to continuously pitch a predetermined number of balls and means for controlling said pitching control means to restart pitching of balls when finished pitching of the predetermined number of balls.

5. A baseball game system used in a batting practice range where a pitching machine is installed to automatically pitch a ball toward a batter's box, wherein a front net installed in front of said batter's box is subdivided to form an out zone and an advanced runner zone for a single hit zone, a two-base hit zone, a three-base hit zone and a home run zone, said baseball game system comprising:

hitting zone detecting means for detecting a ball driven into said out zone or the advanced runner zone from said batter's box;

out counting means for increasing an out-count detected by said hitting zone detection means as an "Out" when a ball is driven into said out zone and for progressing first and last attacks in each inning and resetting the out-count when said out-count becomes a predetermined value;

an electric control portion including score counting means for counting a number of advanced runners detected by said hitting zone detection means when a ball is driven into the advanced runner zone, for calculating an advanced state of runners in each inning based on a counted number of advanced runners, for counting a number of scoring runners as a score, and inning counting means for counting a number of game innings; and display means connected to said out counting means, said score counting means and said inning counting means to display the out-count, the score and progress of the game innings.

6. A baseball game system according to claim 5, wherein said electric control portion further comprises pitching control means for controlling said pitching machine to continuously pitch a predetermined number of balls and means for controlling said pitching control means to restart pitching of balls when finished pitching the predetermined number of balls.

* * * * *